US010144611B2

(12) United States Patent
Sasahara

(10) Patent No.: US 10,144,611 B2
(45) Date of Patent: Dec. 4, 2018

(54) SHEET BINDING DEVICE AND SHEET BINDING METHOD

(71) Applicants: KABUSHIKI KAISHA TOSHIBA, Tokyo (JP); TOSHIBA TEC KABUSHIKI KAISHA, Tokyo (JP)

(72) Inventor: Katsuya Sasahara, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/620,557

(22) Filed: Jun. 12, 2017

(65) Prior Publication Data

US 2018/0057298 A1 Mar. 1, 2018

Related U.S. Application Data

(62) Division of application No. 15/251,887, filed on Aug. 30, 2016.

(51) Int. Cl.

| | |
|---|---|
| ***B65H 37/04*** | (2006.01) |
| ***B42C 9/00*** | (2006.01) |
| ***B65H 31/26*** | (2006.01) |
| ***B65H 37/06*** | (2006.01) |
| ***B65H 35/00*** | (2006.01) |

(52) U.S. Cl.

CPC ..... *B65H 37/04* (2013.01); *B42C 9/0068* (2013.01); *B65H 31/26* (2013.01); *B65H 35/0013* (2013.01); *B65H 37/06* (2013.01); *B65H 2301/51122* (2013.01); *B65H 2301/515323* (2013.01); *B65H 2801/06* (2013.01); *B65H 2801/27* (2013.01)

(58) Field of Classification Search

CPC .. B65H 2301/43821; B65H 2301/5163; B65H 37/04; B42C 9/0056; B42C 9/0068; B42C 9/0075; B42B 5/04

See application file for complete search history.

(56) References Cited

U.S. PATENT DOCUMENTS

| | | | | |
|---|---|---|---|---|
| 4,828,645 A * | 5/1989 | Van Bortel | ..... | B42C 1/125 156/216 |
| 5,980,676 A * | 11/1999 | Meetze | ..... | B42B 5/04 156/216 |
| 8,393,372 B2 * | 3/2013 | Yamauchi | ..... | B65H 37/04 156/384 |
| 8,900,108 B2 * | 12/2014 | Mine | ..... | B65H 27/00 492/53 |

* cited by examiner

*Primary Examiner* — Jeremy R Severson

(74) *Attorney, Agent, or Firm* — Patterson & Sheridan, LLP

(57) ABSTRACT

A sheet binding method according to an embodiment includes holding a sheet bundle in a state where multiple sheets forming the sheet bundle are shifted relative to each other at an edge portion of the sheet bundle. A pressing region of the edge portion is pressed, in a sheet bundle thickness direction, so that there is substantially no slack along the edge portion. While the sheet bundle is pressed, tape is applied to an edge portion of a sheet bundle at a tape attachment region of the edge portion different from the pressing region.

8 Claims, 17 Drawing Sheets

SHEET BINDING DEVICE AND SHEET BINDING METHOD

CROSS-REFERENCE TO RELATED APPLICATION

This application is a division of U.S. patent application Ser. No. 15/251,887, filed on Aug. 30, 2016, the entire contents of each of which are incorporated herein by reference.

FIELD

Embodiments described herein relate generally to a sheet binding device and a sheet binding method.

BACKGROUND

A sheet binding device causes a stapler to bind an edge portion of a sheet bundle. However, if rigidity of the sheet bundle is low, a tip end portion of the sheet bundle buckles in some cases.

DETAILED DESCRIPTION

Figure 1:
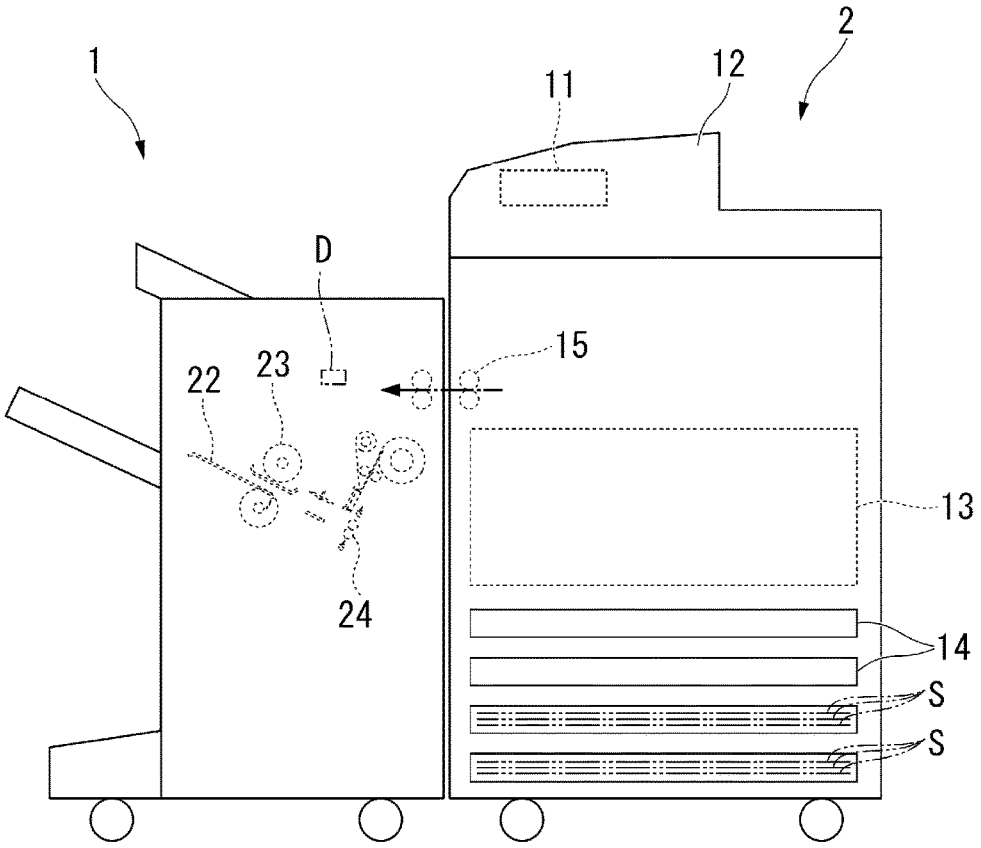
FIG. 1 is a front view illustrating a sheet binding device according to a first embodiment.

A sheet binding device according to an embodiment includes a tape attachment unit and a sheet support unit. The tape attachment unit includes a tap holding unit configured to hold tape that is to be applied to an edge portion of a sheet bundle at a tape attachment region of the edge portion. The sheet support unit holds the sheet bundle in a state where multiple sheets forming the sheet bundle are shifted relative to each other in the edge portion when the tape is applied by the tape attachment unit. The sheet support unit also presses, in a sheet bundle thickness direction, a pressing region of the edge portion different from the tape attachment region so that there is substantially no slack along the edge portion of the sheet bundle between the pressing region and the tape attachment region.

Hereinafter, the sheet binding device and a sheet binding method according to embodiments will be described with reference to the drawings. In the following description, the same reference numerals will be given to configurations having the same or similar function. In some cases, repeated description of the configurations may be omitted.

In this application, various sheet-like media including papers are referred to as "sheets." In this application, a direction substantially orthogonal to a sheet conveying direction which extends along a front surface of the sheet is referred to as a "sheet width direction." The sheet width direction is an example of a direction intersecting the sheet conveying direction.

(First Embodiment)

A first embodiment will be described with reference to FIGS. 1 to 18.

Figure 2:
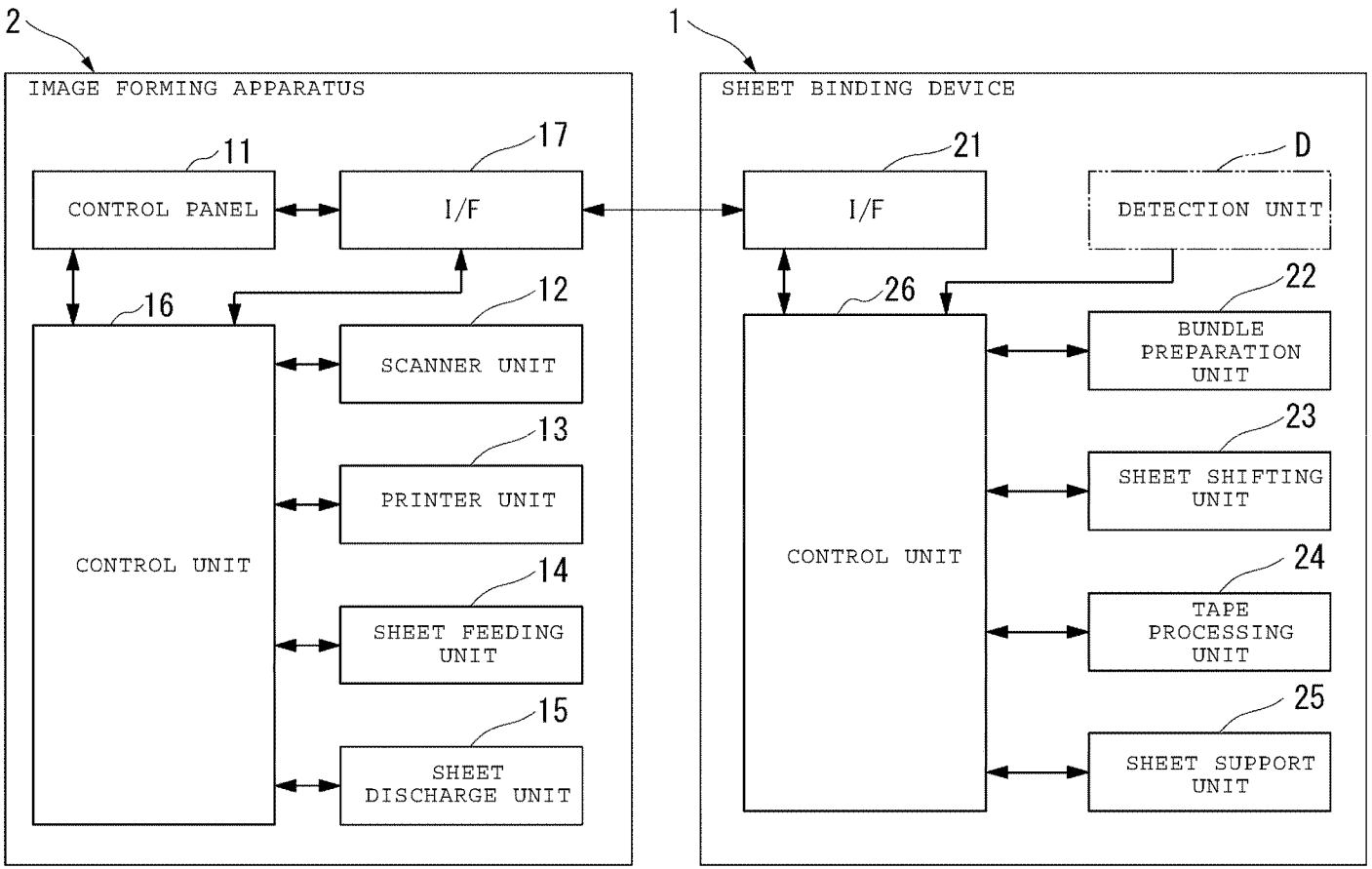
FIG. 2 is a block diagram illustrating a system configuration of the sheet binding device.

FIG. 1 is a front view illustrating a sheet binding device (sheet processing device) 1 according to the first embodiment. FIG. 2 is a block diagram illustrating a system configuration of the sheet binding device 1 according to the first embodiment. The sheet binding device 1 according to the present embodiment binds an edge portion 5*a* of a sheet bundle 5 by using a tape T (refer to FIG. 16). For example, the sheet binding device 1 is a post-processing device which is arranged in the vicinity of an image forming apparatus 2 so as to perform post-processing on a sheet S conveyed from the image forming apparatus 2. Without being limited to the above-described example, the sheet binding device 1 may be used by itself after being placed on a table or a floor, for example.

First, the image forming apparatus 2 will be briefly described.

As illustrated in FIGS. 1 and 2, the image forming apparatus 2 includes a control panel 11, a scanner unit 12, a printer unit 13, a sheet feeding unit 14, a sheet discharge unit 15, a control unit 16, and an interface 17. The control panel 11 includes various keys, and receives a user's operation. The scanner unit 12 reads a copy target and generates corresponding image data. The printer unit 13 forms an image on the sheet S, based on the image data received from the scanner unit 12 or an external device. The sheet feeding unit 14 feeds the sheet S to the printer unit 13. The sheet discharge unit 15 conveys the sheet S discharged from the printer unit 13 to the sheet binding device 1. The control unit 16 controls various operations of the control panel 11, the scanner unit 12, the printer unit 13, the sheet feeding unit 14, the sheet discharge unit 15, and the interface 17.

The interface 17 is connected to an interface 21 of the sheet binding device 1 in a wired or wireless manner. The image forming apparatus 2 transmits information on the sheet bundle 5 formed by the sheet S discharged from the image forming apparatus 2, to the sheet binding device 1 through the interface 17. For example, the "information on the sheet bundle 5" includes at least any one of: the number of sheets S bound as one sheet bundle 5 (that is, the number of sheets S forming one sheet bundle 5), a thickness of the sheet bundle 5, and information for each sheet S. That is, the "information on the sheet bundle 5" may be information of the sheet bundle 5, or may be information on the sheet S by itself. The information on the sheet S by itself includes at least any one of: the thickness of the sheet S, an orientation of the sheets S, and a type (material) of the sheet S.

Next, the sheet binding device 1 will be described.

As illustrated in FIG. 2, the sheet binding device 1 includes the interface 21, a bundle preparation unit 22, a sheet shifting unit 23, a tape processing unit 24, a sheet support unit 25, and a control unit 26.

The interface 21 is an example of the "information acquisition unit", and acquires the above-described information on the sheet bundle 5. For example, the interface 21 acquires the information on the sheet bundle 5 from the image forming apparatus 2 serving as an external apparatus.

Next, the bundle preparation unit 22 will be described.

Figure 3:
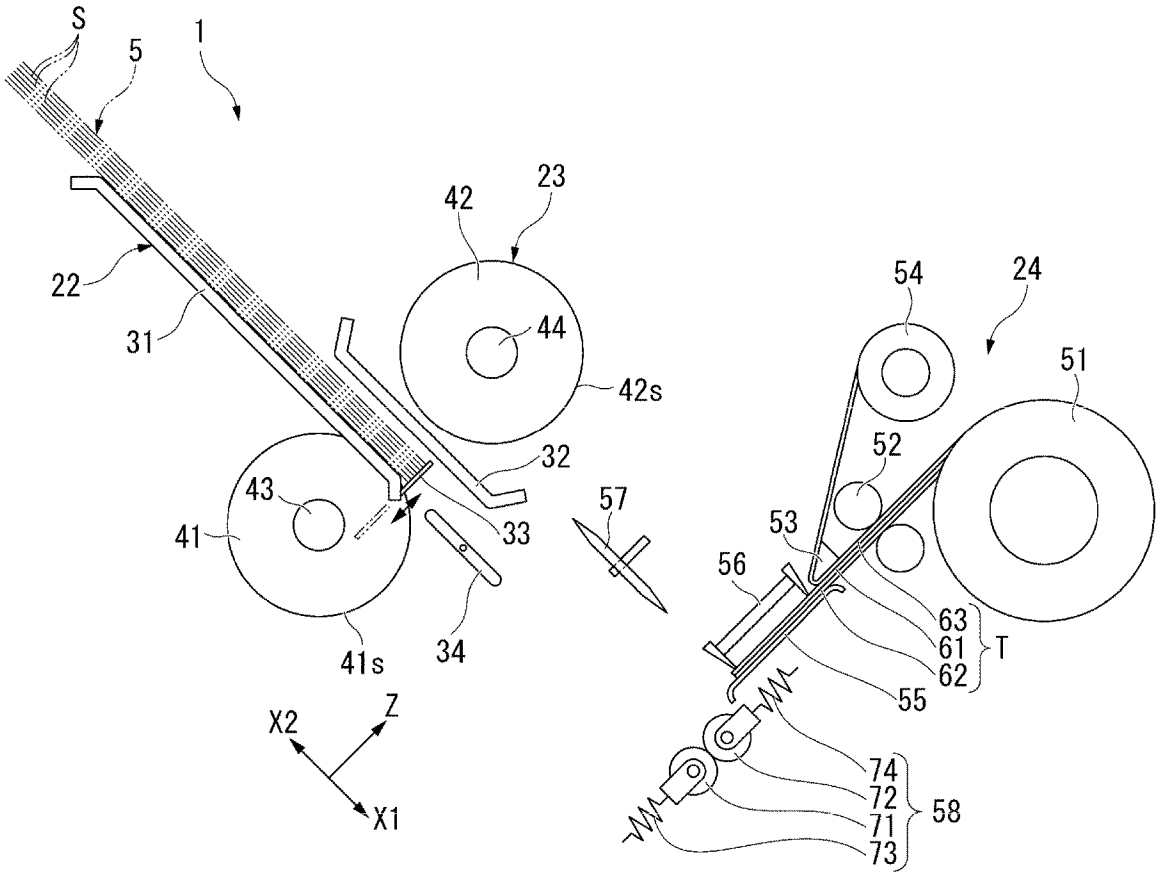
FIG. 3 is a front view illustrating an internal configuration of the sheet binding device.

FIG. 3 is a front view illustrating an internal configuration of the sheet binding device 1.

As illustrated in FIG. 3, the bundle preparation unit 22 stacks multiple sheets S one on another, thereby preparing the sheet bundle 5. The bundle preparation unit 22 includes a main guide 31, a sub-guide 32, a stopper 33, and a switching member 34.

The main guide 31 guides the sheet S along a sheet conveying direction X1. The multiple sheets S are sequentially stacked on the main guide 31, thereby forming the sheet bundle 5.

The sub-guide 32 faces the main guide 31 in a thickness direction Z of the sheet bundle 5 (hereinafter, referred to as a sheet bundle thickness direction). A space for stacking the sheets S is arranged between the main guide 31 and the sub-guide 32.

The stopper 33 is arranged on a downstream side end portion of the main guide 31 in the sheet conveying direction X1. The stopper 33 is movable between a regulating position (illustrated by a solid line in FIG. 3) and a releasing position (illustrated by a two-dot chain line in FIG. 3) by a movement mechanism (not illustrated). At the regulating position, the stopper 33 protrudes upward from an upper surface of the main guide 31. At the regulating position, an end portion of the sheet S comes into contact with the stopper 33, thereby causing the stopper 33 to block the sheet S. Therefore, the sheets S are accumulated on the main guide 31, forming the sheet bundle 5. At the releasing position, the stopper 33 is retracted downward from the upper surface of the main guide 31. At the releasing position, the stopper 33 allows the sheet bundle 5 on the main guide 31 to move toward the switching member 34.

The switching member 34 switches conveying paths of the sheet bundle 5. Hereinafter, a direction in which the sheet bundle 5 is conveyed toward the tape processing unit 24 (specifically, a tape attachment unit 58 to be described later) is referred to as a "first conveying direction". A direction in which the sheet bundle 5 is conveyed toward a position different from the tape attachment unit 58 (for example, downward away from the bundle preparation unit 22) is referred to as a "second conveying direction". The switching member 34 switches the conveying paths of the sheet bundle 5 between the first conveying direction and the second conveying direction.

Next, the sheet shifting unit 23 will be described.

The sheet shifting unit 23 sequentially shifts the multiple sheets S little by little in the sheet conveying direction X1, thereby forming a state where the multiple sheets S forming the sheet bundle 5 are shifted from each other in the edge portion 5*a* of the sheet bundle 5. For example, the sheet shifting unit 23 forms a state where the multiple sheets S are shifted in the edge portion 5*a* of the sheet bundle 5 in a stepwise manner.

Figure 4A:
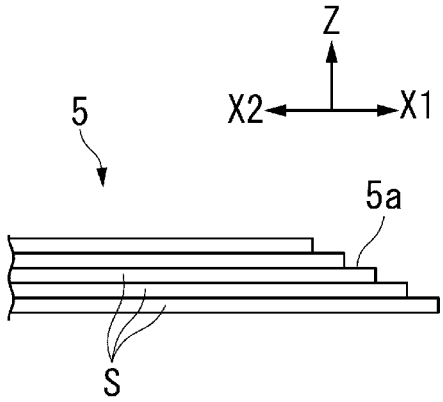
FIGS. 4A and 4B are side views illustrating a state where multiple sheets are shifted in an edge portion of a sheet bundle.
Figure 4B:
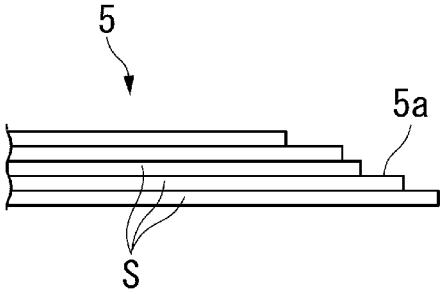

FIGS. 4A and 4B are side views illustrating a state where the multiple sheets S forming the sheet bundle 5 are shifted from each other in the edge portion 5*a* of the sheet bundle 5. As illustrated in FIGS. 4A and 4B, the "state where the multiple sheets S forming the sheet bundle 5 are shifted from each other in the edge portion 5*a*" described in this application means a state where the multiple sheets S are stacked while being shifted from each other. In other words, the state means stacked edge portions of the multiple sheets S are shifted from each other and the edge portions of the multiple sheets S forming the sheet bundle 5 have a step difference. Furthermore, in other words, the state means that the multiple sheets S are partially stacked in a stepwise manner. For example, the "state where the multiple sheets S forming the sheet bundle 5 are shifted in the edge portion 5*a* in the stepwise manner" described in this application means a state where a protruding amount of the sheets S in the sheet conveying direction X1 gradually increases (or gradually decreases) in the stacked order of the multiple sheets S. Without being limited to a state where the multiple sheets S are substantially evenly shifted from each other (refer to FIG. 4A), the state may include a state where the multiple sheets S are unevenly shifted from each other (refer to FIG. 4B).

As illustrated in FIG. 3, in order to form these states, the sheet shifting unit 23 includes a first roller 41 and a second roller 42. The first roller 41 is an example of a "first contact member". The second roller 42 is an example of a "second contact member".

The first roller 41 is attached to a first shaft 43. The first roller 41 functions as a driving roller driven by a motor (not illustrated) via the first shaft 43. The first roller 41 is fixed at a stationary position. A material of the first roller 41 is not particularly limited. For example, the first roller 41 is formed using ethylene-propylene-diene rubber (EPDM).

The second roller 42 is attached to a second shaft 44. For example, the second roller 42 functions as a driven roller rotated in accordance with the rotation of the first roller 41. The second roller 42 is movable in a direction towards the first roller 41 and in a direction away from the first roller 41 by a movement mechanism (not illustrated). The second roller 42 moves toward the first roller 41, thereby coming into contact with the sheet bundle 5 from a side opposite to the first roller 41.

Figure 5:
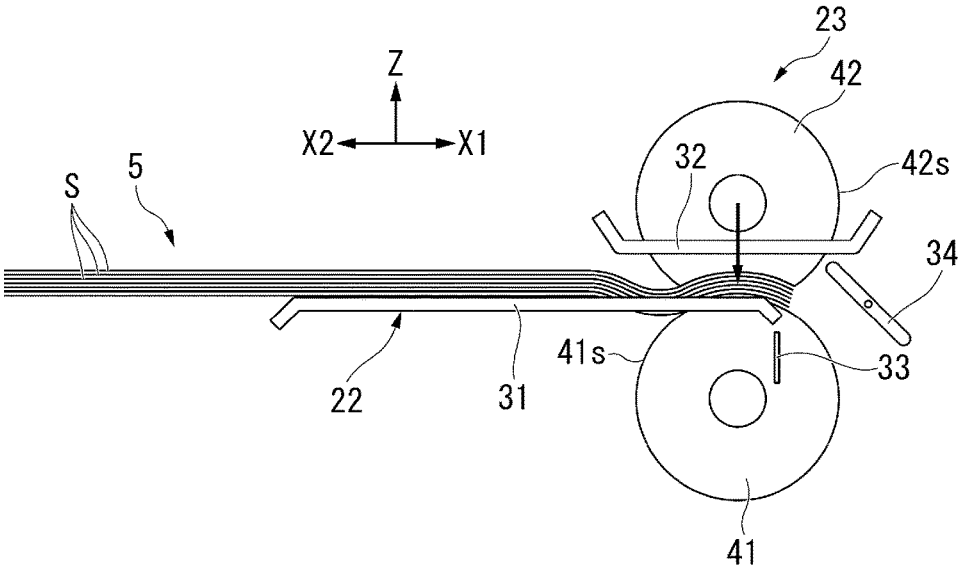
FIG. 5 is a front view illustrating an operation of the sheet binding device.

Here, an outer peripheral surface 42*s* of the second roller 42 is softer than an outer peripheral surface 41*s* of the first roller 41, and is deformable along a front surface of the sheet bundle 5 (refer to FIG. 5). For example, the second roller 42 is formed using a sponge or rubber which internally has a cavity. If the second roller 42 is moved towards the first roller 41, the outer peripheral surface 42*s* of the second roller 42 is deformed in an arc shape along the outer peripheral surface 41*s* of the first roller 41, together with the sheet bundle 5. In this state, the first roller 41 is driven, thereby forming a state where the multiple sheets S are shifted in at the edge portion 5*a* of the sheet bundle 5 in the stepwise manner. This principle will be described in detail later.

Next, the tape processing unit 24 will be described.

As illustrated in FIG. 3, the tape processing unit 24 includes an unwinding unit 51, a tape conveying unit 52, a separation member 53, a winding unit 54, a guide base 55, a tape holding unit 56, a cutter 57, and a tape attachment unit 58.

The unwinding unit 51 is an example of a "tape supply unit". For example, the unwinding unit 51 holds an original roll around which a strip-like tape T (hereinafter, simply referred to as a "tape T") is wound. The unwinding unit 51 supplies the tape T along a longitudinal direction of the tape T. In a state where the tape T is accommodated in the unwinding unit 51, the tape T includes an adhesive layer 61, a protection film (first film) 62, and a release film (second film) 63. The protection film 62 covers the adhesive layer 61 from one side. The protection film 62 is integrated with the adhesive layer 61 when the tape T is used. The release film 63 covers the adhesive layer 61 from a side opposite to the protection film 62. The release film 63 is released from the adhesive layer 61 when the tape T is used. The release film 63 is wound by the separation member 53 and the winding unit 54.

The tape conveying unit 52 conveys the tape T supplied from the unwinding unit 51, along the longitudinal direction of the tape T. For example, the longitudinal direction of the tape T is a direction which is substantially parallel to the sheet bundle thickness direction Z.

The guide base 55 guides the tape T from which the release film 63 is separated. For example, the guide base 55 supports the tape T when the tape T is held and cut.

In a state where the tape holding unit 56 holds a posture of the tape T so as to be substantially flat, the tape holding unit 56 supports the tape T. The tape holding unit 56 is movable along the longitudinal direction of the tape T by a movement mechanism (not illustrated). The tape holding unit 56 is movable in the direction towards the tape T and in the direction away from the tape T by a movement mechanism (not illustrated).

The cutter 57 cuts the strip-like tape T supplied from the unwinding unit 51 to form the tape T having a sheet shape. The cutter 57 is movable in the direction towards the tape T and in the direction away from the tape T by a movement mechanism (not illustrated).

The tape attachment unit (tape wrapping unit) 58 includes a first roller 71, a second roller 72, a first spring 73, and a second spring 74. The first spring 73 urges the first roller 71 toward the second roller 72. The second spring 74 urges the second roller 72 toward the first roller 71. The first roller 71 and the first spring 73 cooperate with each other, thereby forming an example of a "first urging unit". The second roller 72 and the second spring 74 cooperate with each other, thereby forming an example of a "second urging unit". The edge portion 5*a* of the sheet bundle 5 together with the tape T is inserted into a portion between the first roller 71 and the second roller 72, when the tape T is attached thereto. In this manner, the tape T is bent so that the edge portion 5*a* of the sheet bundle 5 is wrapped by the tape attachment unit 58, and the tape T is attached to the edge portion 5*a* of the sheet bundle 5.

Here, prior to the description of the sheet support unit 25, a series of operation examples relating to the bundle preparation unit 22, the sheet shifting unit 23, and the tape processing unit 24 will be described. FIGS. 5 to 16 are front views illustrating the operation examples of the sheet binding device 1.

First, as illustrated in FIG. 3, the sheet binding device 1 moves the stopper 33 to the regulating position, thereby blocking the sheet S conveyed along the main guide 31. In this manner, the multiple sheets S are sequentially stacked one on another, thereby forming the sheet bundle 5. Subsequently, the sheet binding device 1 moves the stopper 33 to the releasing position. The sheet binding device 1 switches the switching member 34 to be oriented in the second conveying direction.

Subsequently, as illustrated in FIG. 5, the sheet binding device 1 moves the second roller 42 toward the first roller 41. In this manner, the sheet bundle 5 and the outer peripheral surface 42*s* of the second roller 42 are deformed in an arc shape along the outer peripheral surface 41*s* of the first roller 41.

Figure 6:
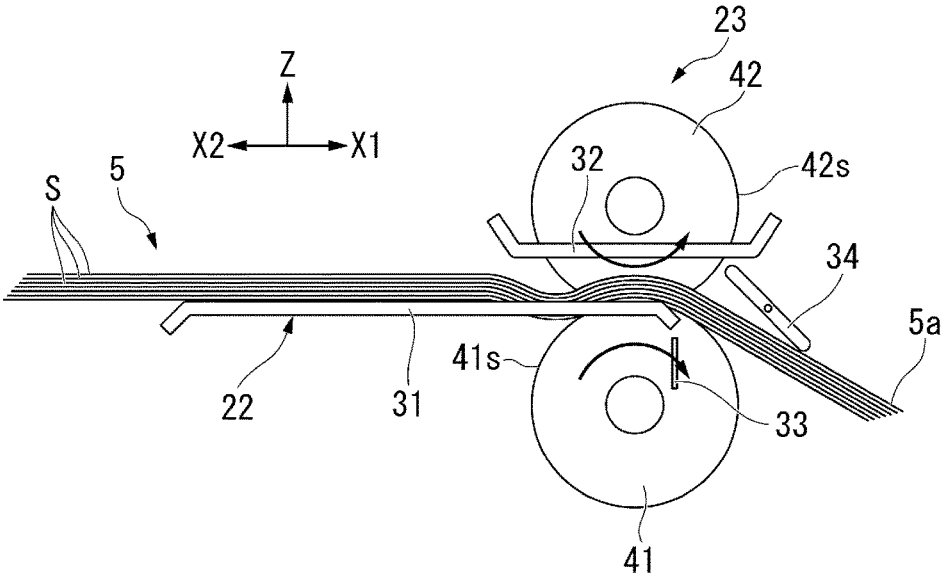
FIG. 6 is a front view illustrating an operation of the sheet binding device, subsequent to FIG. 5.

Then, as illustrated in FIG. 6, in a state where the sheet bundle 5 is interposed between the first roller 41 and the second roller 42, the sheet binding device 1 rotates the first roller 41 forward. In this manner, the second roller 42 maintains a state of being recessed along the outer peripheral surface 41*s* of the first roller 41, and is rotated in accordance with the rotation of the first roller 41. As a result, this forms a state where the multiple sheets S are shifted in the edge portion 5*a* of the sheet bundle 5 in the sheet conveying direction X1 in a stepwise manner. The "edge portion 5*a* of the sheet bundle 5" in the following description means the edge portion 5*a* of the sheet bundle 5 in which the multiple sheets S are shifted in the stepwise manner.

Here, a principle in which the multiple sheets S are shifted in the stepwise manner will be described.

Figure 7:
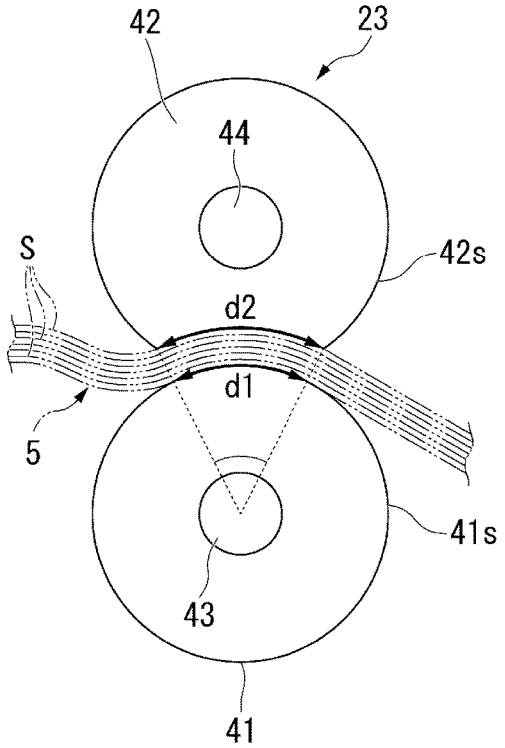
FIG. 7 is a front view illustrating a principle of shifted sheets in the first embodiment.

FIG. 7 is a front view illustrating the principle in which the multiple sheets S are shifted in the stepwise manner.

As illustrated in FIG. 7, if the second roller 42 comes into pressing contact with the first roller 41 via the sheet bundle 5, the outer peripheral surface 42*s* of the second roller 42 is deformed in an arc shape along the outer peripheral surface 41*s* of the first roller 41. Here, a length (arc length) d1 in a circumferential direction of a portion in contact with the sheet bundle 5 on the outer peripheral surface 41*s* of the first roller 41 is referred to as a "first length d1". A length (arc length) d2 in a direction along the circumferential direction of the first roller 41 of a portion (recessed portion) in contact with the sheet bundle 5 on the outer peripheral surface 42*s* of the second roller 42 is referred to as a "second length d2". The second length d2 is longer than the first length d1. In this state, the sheet binding device 1 rotates the first roller 41 and the second roller 42, thereby feeding the sheet bundle 5 in the sheet conveying direction X1. At this time, a movement distance of the outer peripheral surface 42*s* of the second roller 42 is longer than a movement distance of the outer peripheral surface 41*s* of the first roller 41. That is, a feeding amount of the sheet bundle 5 in the sheet conveying direction X1 increases as the sheet bundle 5 is closer to the second roller 42. This forms a state where the multiple sheets S are shifted in the edge portion 5*a* of the sheet bundle 5 in a stepwise manner.

Figure 8:
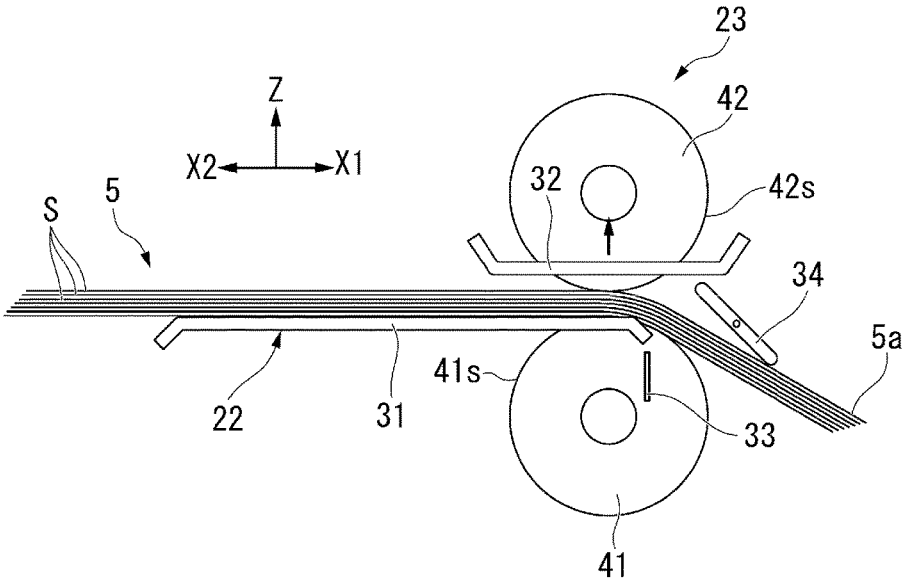
FIG. 8 is a front view illustrating an operation of the sheet binding device, subsequent to FIG. 6.

Subsequently, as illustrated in FIG. 8, the sheet binding device 1 moves the second roller 42 in a direction away from the first roller 41. This eliminates the recess of the outer peripheral surface 42*s* of the second roller 42.

Figure 9:
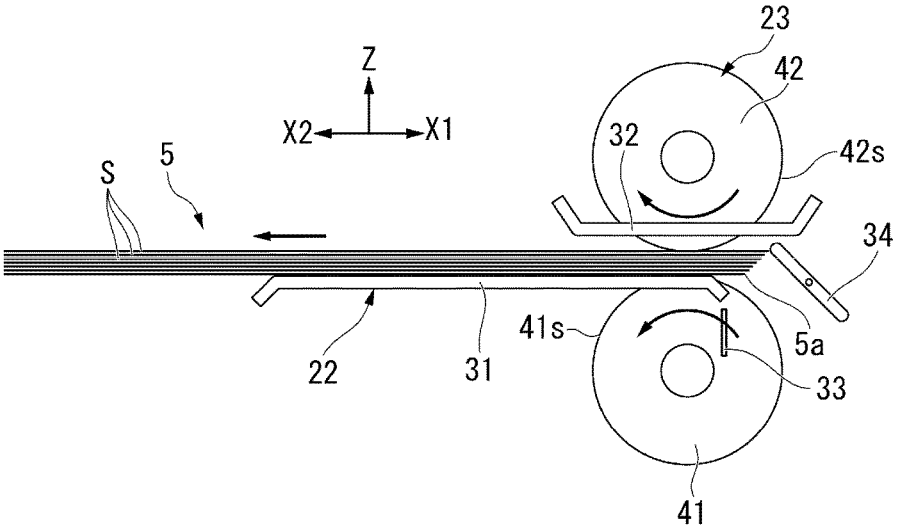
FIG. 9 is a front view illustrating an operation of the sheet binding device, subsequent to FIG. 8.

Subsequently, as illustrated in FIG. 9, the sheet binding device 1 rotates the first roller 41 and the second roller 42 rearward, thereby moving the sheet bundle 5 in a direction X2 opposite to the sheet conveying direction X1.

Figure 10:
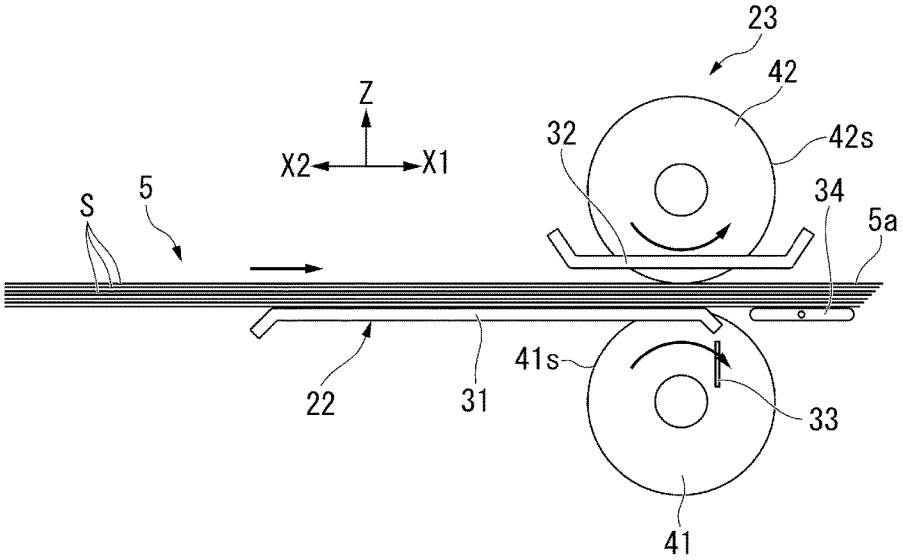
FIG. 10 is a front view illustrating an operation of the sheet binding device, subsequent to FIG. 9.

Subsequently, as illustrated in FIG. 10, the sheet binding device 1 switches the switching member 34. Thus, the conveying path is switched from the second conveying direction to the first conveying direction. Then, the sheet binding device 1 rotates the first roller 41 and the second roller 42 forward, thereby moving the sheet bundle 5 toward the tape attachment unit 58.

Figure 11:
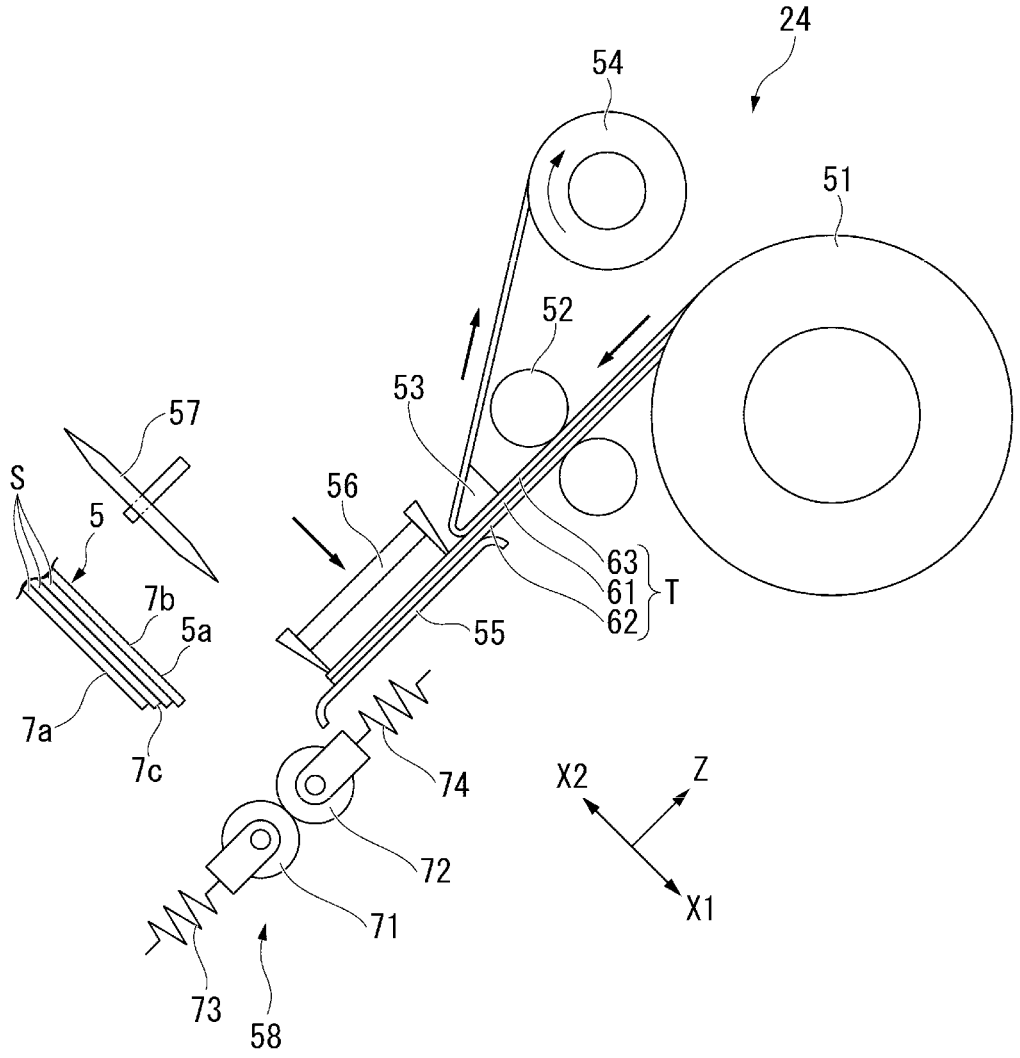
FIG. 11 is a front view illustrating an operation of the sheet binding device, subsequent to FIG. 10.

Subsequently, as illustrated in FIG. 11, the sheet binding device 1 feeds the tape T out from the unwinding unit 51 in advance. At this time, the tape holding unit 56 supports the tape T in a state of holding a posture of the tape T.

Figure 12:
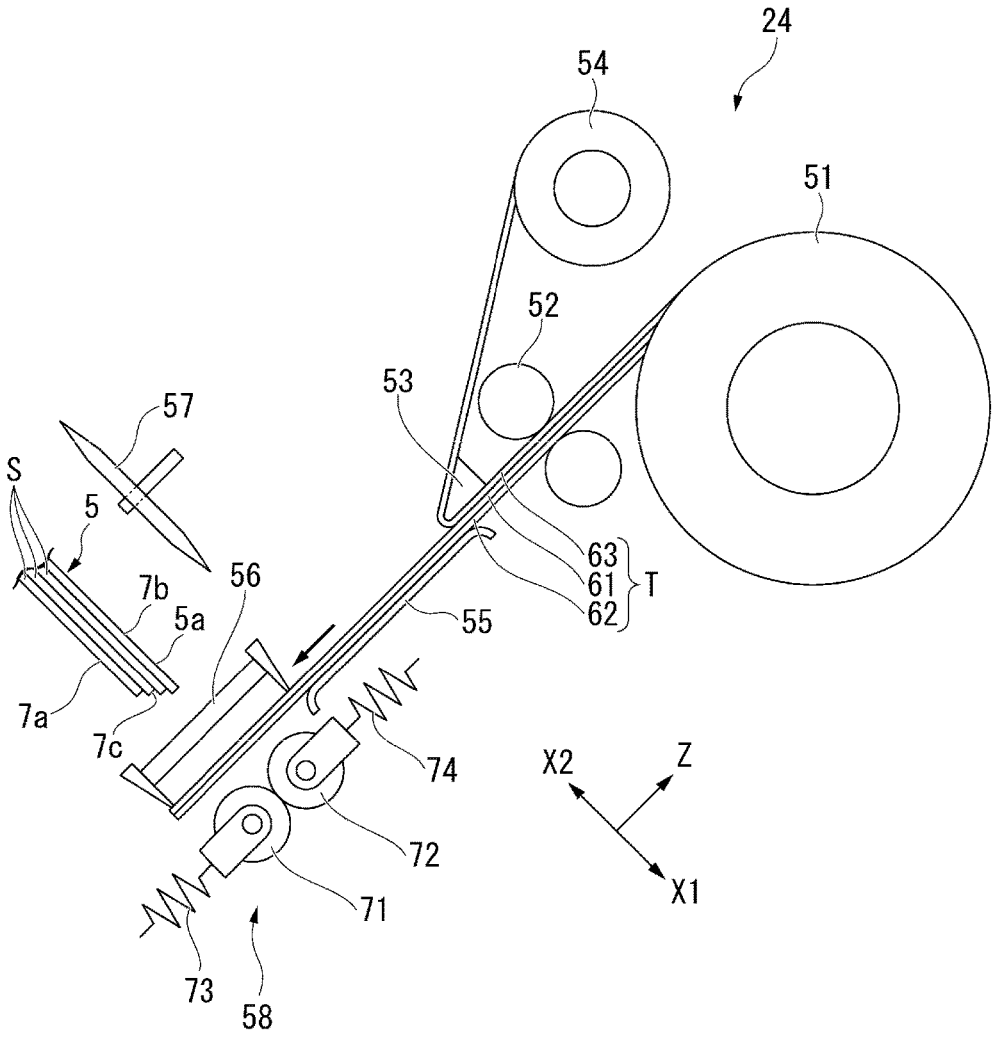
FIG. 12 is a front view illustrating an operation of the sheet binding device, subsequent to FIG. 11.

Subsequently, as illustrated in FIG. 12, the sheet binding device 1 moves the tape holding unit 56 to a portion between the sheet bundle 5 and the tape attachment unit 58. For example, the tape holding unit 56 arranges the tape T across the first roller 71 and the second roller 72.

Figure 13:
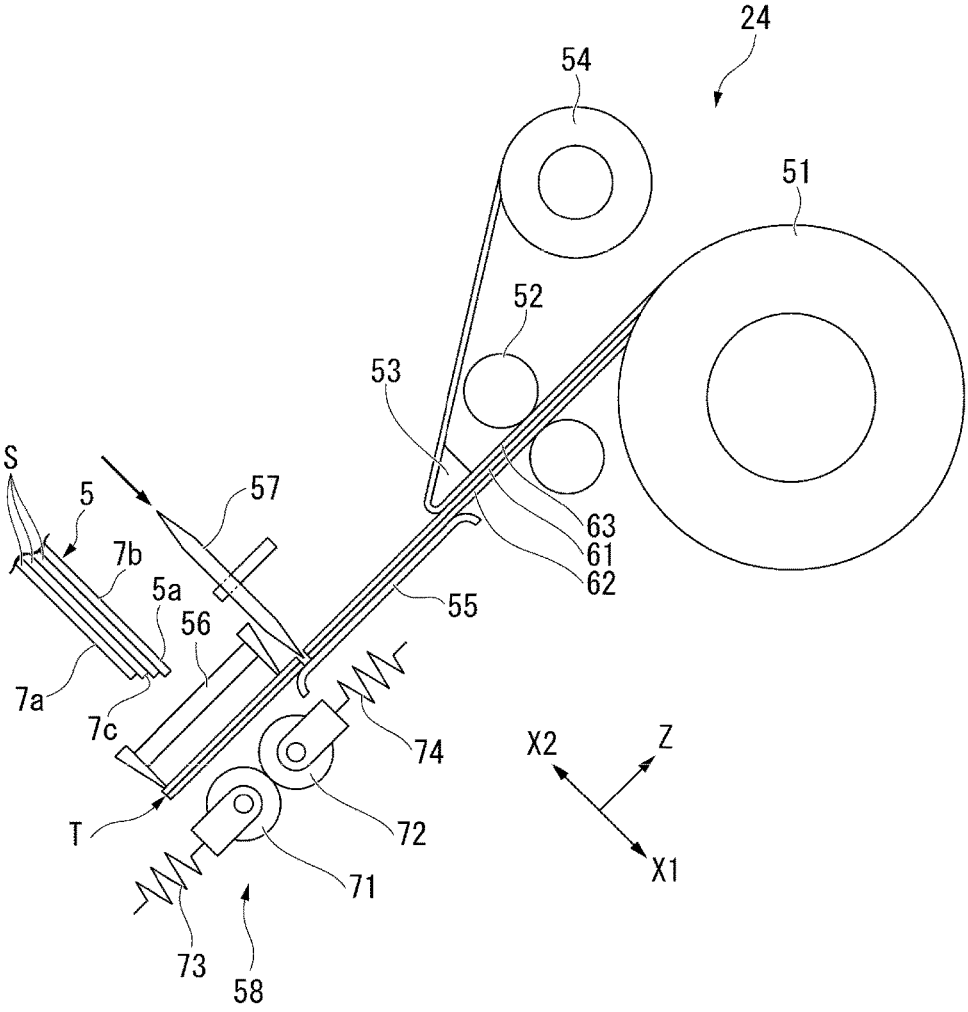
FIG. 13 is a front view illustrating an operation of the sheet binding device, subsequent to FIG. 12.

Subsequently, as illustrated in FIG. 13, the sheet binding device 1 causes the cutter 57 to cut the strip-like tape T, and forms the tape T having a sheet shape.

Figure 14:
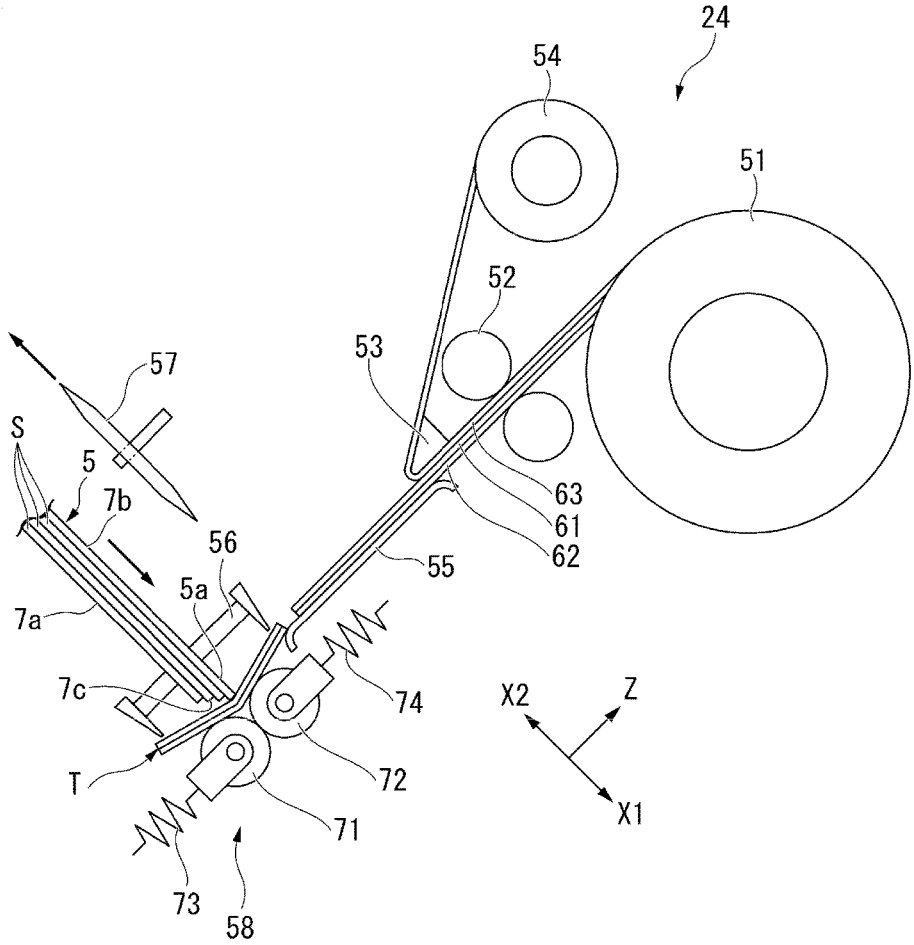
FIG. 14 is a front view illustrating an operation of the sheet binding device, subsequent to FIG. 13.

Subsequently, as illustrated in FIG. 14, the sheet binding device 1 rotates the first roller 41 and the second roller 42 forward, thereby moving the sheet bundle 5 toward the tape attachment unit 58. Then, the sheet binding device 1 brings the tip end of the edge portion 5*a* of the sheet bundle 5 into contact with the tape T. In this manner, the sheet binding device 1 inserts the edge portion 5*a* of the sheet bundle 5 together with the tape T into a portion between the first roller 71 and the second roller 72.

Figure 15:
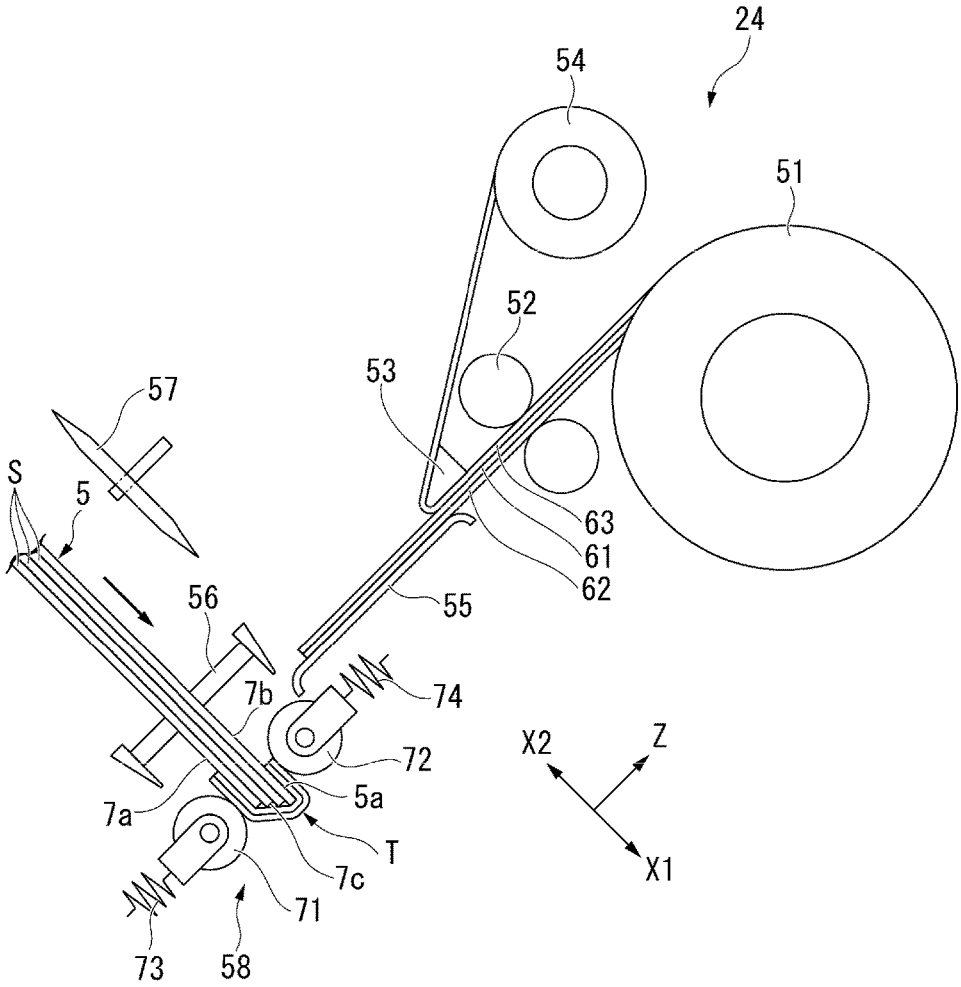
FIG. 15 is a front view illustrating an operation of the sheet binding device, subsequent to FIG. 14.

Subsequently, as illustrated in FIG. 15, when the edge portion 5*a* of the sheet bundle 5 together with the tape T is inserted into the portion between the first roller 71 and the second roller 72, the first roller 71 and the second roller 72 are moved along an outer shape of the edge portion 5*a* of the sheet bundle 5. In this manner, the first roller 71 and the second roller 72 press the tape T against the edge portion 5*a* of the sheet bundle 5. As a result, the tape T subsequently adheres to the stepwise portion of the sheet bundle 5. Here, the sheet bundle 5 has a first surface 7*a*, a second surface 7*b*, and an end surface 7*c*. The first surface 7*a* and the second surface 7*b* are formed along the sheet conveying direction X1. The second surface 7*b* is located on a side opposite to the first surface 7*a*. The end surface 7*c* is located between the first surface 7*a* and the second surface 7*b*, thereby shifting the multiple sheets S in the stepwise manner. The sheet S is attached over the first surface 7*a*, the end surface 7*c*, and the second surface 7*b* in the edge portion 5*a* of the sheet bundle 5. In this manner, all of the sheets S including middle pages of the sheet bundle 5 are integrated by the tape T. In this manner, processing for attaching the tape T to the edge portion 5*a* of the sheet bundle 5 is completed.

Figure 16:
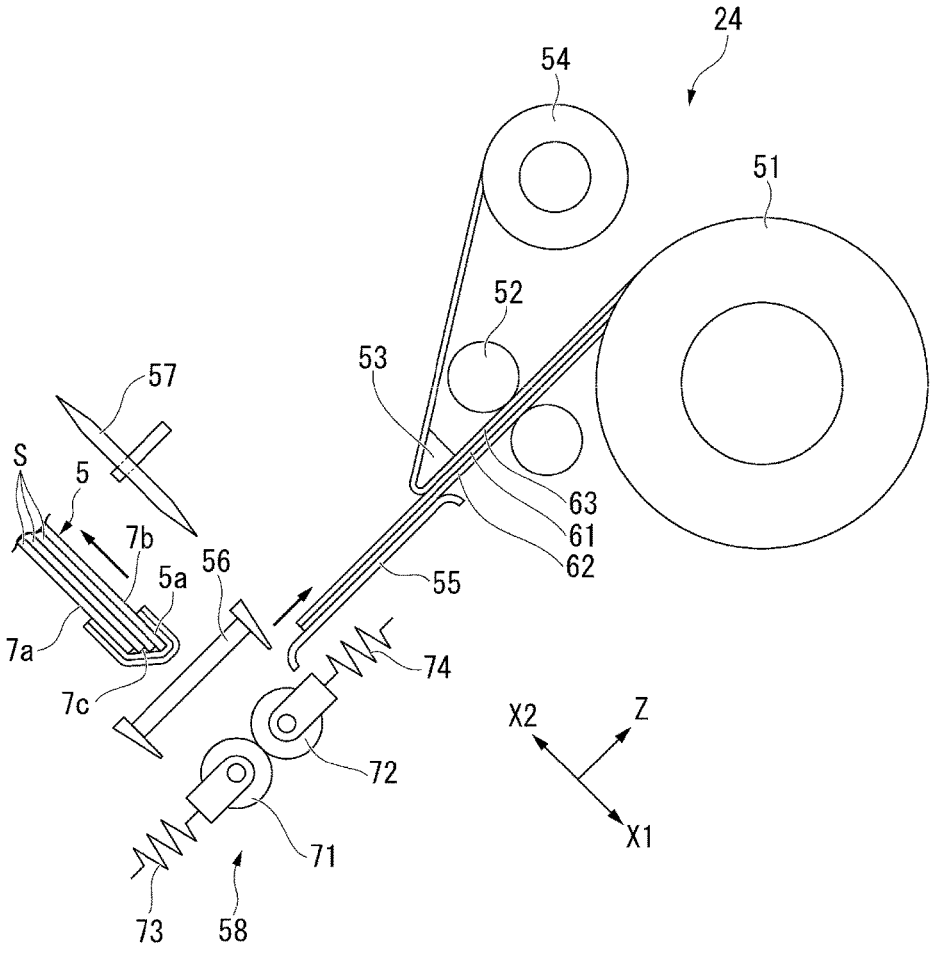
FIG. 16 is a front view illustrating an operation of the sheet binding device, subsequent to FIG. 15.

Subsequently, as illustrated in FIG. 16, the sheet binding device 1 rotates the first roller 41 and the second roller 42 rearward, thereby drawing the sheet bundle 5 from a portion between the first roller 71 and the second roller 72. Then, the sheet binding device 1 further rotates the first roller 41 and the second roller 42 rearward, thereby discharging the sheet bundle 5 to a discharge unit (not shown) of the sheet binding device 1.

According to the above-described configuration, a series of operations relating to the bundle preparation unit 22, the sheet shifting unit 23, and the tape processing unit 24 is completed.

Next, the sheet support unit 25 will be described.

Figure 17:
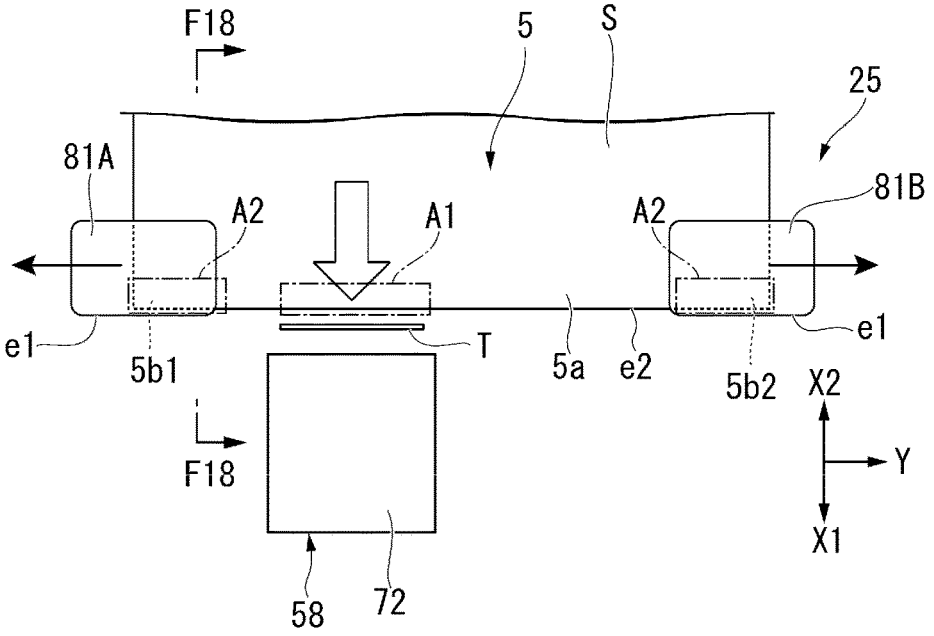
FIG. 17 is a plan view illustrating a sheet support unit according to the first embodiment.
Figure 18:
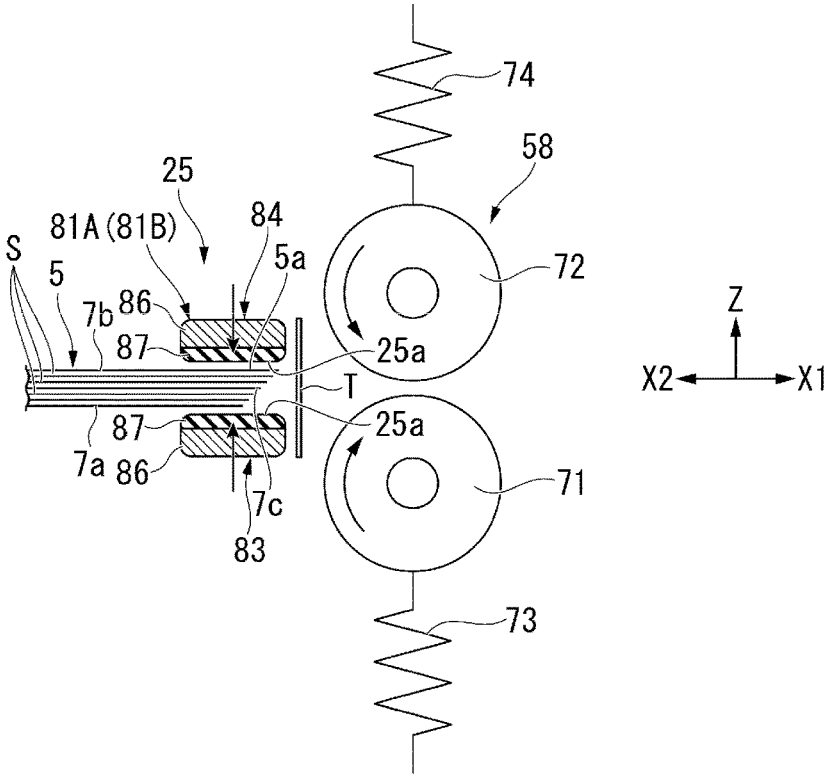
FIG. 18 is a sectional view taken along line F18-F18 of the sheet support unit illustrated in FIG. 17.

FIG. 17 is a plan view illustrating the sheet support unit 25 according to the embodiment described herein. FIG. 18 is a sectional view taken along line F18-F18 of the sheet support unit 25 illustrated in FIG. 17.

As illustrated in FIGS. 17 and 18, the sheet support unit 25 is arranged on an upstream side of the tape attachment unit 58 in the sheet conveying direction X1. In other words, the sheet support unit 25 is arranged between the bundle preparation unit 22 and the tape attachment unit 58 in the sheet conveying direction X1. The sheet support unit 25 faces the edge portion 5*a* of the sheet bundle 5 in the sheet bundle thickness direction Z. For example, when viewed in the sheet bundle thickness direction Z, a downstream side end e1 of the sheet support unit 25 in the sheet conveying direction X1 is substantially aligned with a downstream side end e2 of the sheet bundle 5 in the sheet conveying direction X1. The downstream side end e1 of the sheet support unit 25 in the sheet conveying direction X1 is located on the downstream side further from the downstream side end e2 of the sheet bundle 5 in the sheet conveying direction X1.

Here, the edge portion 5*a* of the sheet bundle 5 includes a tape attachment region (first region) A1 to which the tape T is attached and a region A2 different from the tape attachment region A1 (tape non-attachment region, second region). When the tape T is attached to the edge portion 5*a* of the sheet bundle 5 by the tape attachment unit 58, the sheet support unit 25 holds the multiple sheets S forming the sheet bundle 5 which are shifted in the edge portion 5*a* of the sheet bundle 5 in a stepwise manner. The region A2 (different from the tape attachment region A1*s*0 in the edge portion 5*a* of the sheet bundle 5 is pressed in the sheet bundle thickness direction Z so as to remove any slack. For example, the sheet support unit 25 presses the region A2 different from the tape attachment region A1 in the sheet bundle thickness direction Z so as to be substantially flat.

From another viewpoint, the sheet support unit 25 according to the embodiment described herein presses the sheet bundle 5 in the sheet bundle thickness direction Z, at a position on both sides of the tape attachment region A1 in the sheet width direction Y. For example, the sheet support unit 25 according to the embodiment described herein includes a pair of tensile members 81A and 81B. The pair of tensile members 81A and 81B are located separately on both sides of the tape attachment region A1 in the sheet width direction Y. For example, the pair of tensile members 81A and 81B are arranged corresponding to both end portions 5*b*1 and 5*b*2 of the sheet bundle 5 in the sheet width direction Y. The sheet support unit 25 causes the pair of tensile members 81A and 81B to press the sheet bundle 5 at a position on both sides of the tape attachment region A1.

The pair of tensile members 81A and 81B are examples of a "tension applying unit". The pair of tensile members 81A and 81B apply tension to the edge portion 5*a* of the sheet bundle 5 in the sheet width direction Y.

As illustrated in FIG. 18, each of the pair of tensile members 81A and 81B includes a first pressing pad (first pressing portion) 83 and a second pressing pad (second pressing portion) 84. The first pressing pad 83 and the second pressing pad 84 are located separately on both sides (for example, upper and lower sides) of the sheet bundle 5 in the sheet bundle thickness direction Z. Each of the first pressing pad 83 and the second pressing pad 84 is movable in the direction towards each other and in the direction away from each other, in the sheet bundle thickness direction Z, by a movement mechanism (not illustrated). The first pressing pad 83 and the second pressing pad 84 are moved in the direction towards each other, thereby interposing and holding the edge portion 5*a* of the sheet bundle 5 between the first pressing pad 83 and the second pressing pad 84. Instead of the above-described configuration, any one of the first pressing pad 83 and the second pressing pad 84 may be fixed at a stationary position so that only the other one of the first pressing pad 83 and the second pressing pad 84 is movable.

Each of the first pressing pad 83 and the second pressing pad 84 includes an elastic member (for example, a rubber member) 87 on a surface 25*a* which comes into contact with at least the sheet bundle 5. In the embodiment described herein, each of the first pressing pad 83 and the second pressing pad 84 includes a pad main body 86 which is rigid and the elastic member 87 attached to the pad main body 86. Alternatively, in each of the first pressing pad 83 and the second pressing pad 84, the entire body may be formed using the elastic member 87 (for example, a rubber member).

As illustrated in FIG. 17, the pair of tensile members 81A and 81B are movable in the direction away from each other and in the direction towards each other, in the sheet width direction Y, by a movement mechanism (not illustrated). Each of the pair of tensile members 81A and 81B is an example of a "movable portion" which is movable along the sheet width direction Y. The pair of tensile members 81A and 81B are moved in the direction away from each other in a state of holding the sheet bundle 5 between the first pressing pad 83 and the second pressing pad 84. For example, the pair of tensile members 81A and 81B hold both end portions 5*b*1 and 5*b*2 of the edge portion 5*a* of the sheet bundle 5, and pull both end portions 5*b*1 and 5*b*2 of the edge portion 5*a* of the sheet bundle 5 to both outer sides in the sheet width direction Y. In this manner, tension is applied to the edge portion 5*a* of the sheet bundle 5 in the sheet width direction Y. As a result, the edge portion 5*a* of the sheet bundle 5 is brought into a state of being stretched so as to be substantially flat (state of no slack). Instead of the above-described configuration, any one of the pair of tensile members 81A and 81B maybe fixed at a stationary position so that only the other one of the pair of tensile members 81A and 81B is movable. The "pair of tensile members" described in this application may mutually have different shapes or sizes.

When the tap T is attached to the edge portion 5*a* of the sheet bundle 5, the pair of tensile members 81A and 81B may be moved toward the downstream side in the sheet conveying direction X1 by a movement mechanism (not illustrated), in a state where the sheet bundle 5 is held by the pair of tensile members 81A and 81B. In this manner, the pair of tensile members 81A and 81B insert the edge portion 5*a* of the sheet bundle 5 together with the tape T into a portion between the first roller 71 and the second roller 72 of the tape attachment unit 58. Alternatively, the pair of tensile members 81A and 81B may not have a movement mechanism in the sheet conveying direction X1. In this case, the tape holding unit 56 and the tape attachment unit 58 may move and go toward the sheet bundle 5 whose position is fixed so as to attach the tape T to the edge portion 5*a* of the sheet bundle 5. These operations are the same as those of the sheet support unit 25 according to the second and third embodiments.

Next, an operation example of the sheet binding device 1 which includes an operation of the sheet support unit 25 will be described.

The sheet binding device 1 causes the bundle preparation unit 22 to prepare the sheet bundle 5, and causes the sheet shifting unit 23 to form a state where the multiple sheets S are shifted in the edge portion 5*a* of the sheet bundle 5. Thereafter, the sheet binding device 1 rotates the first roller 41 and the second roller 42 of the sheet shifting unit 23 forward, thereby feeding the sheet bundle 5 toward the sheet support unit 25.

When the sheet bundle 5 is fed to the sheet shifting unit 23, the sheet binding device 1 moves the first pressing pad 83 and the second pressing pad 84 of the pair of tensile members 81A and 81B toward the sheet bundle 5, and causes the first pressing pad 83 and the second pressing pad 84 to interpose and hold the sheet bundle 5 therebetween. In this state, the sheet binding device 1 moves the pair of tensile members 81A and 81B toward both outer sides in the sheet width direction Y. In this manner, the edge portion 5*a* of the sheet bundle 5 is brought into a state of being stretched so as to be substantially flat, and thus, the edge portion 5*a* of the sheet bundle 5 no longer has any slack In a state where the edge portion 5*a* of the sheet bundle 5 is stretched so as to be substantially flat, the sheet binding device 1 causes the tape attachment unit 58 to attach the tape T to the edge portion 5*a* of the sheet bundle 5. That is, before the sheet bundle 5 together with the tape T is inserted into a portion between the first roller 71 and the second roller 72, the sheet support unit 25 comes into contact with the sheet bundle 5, and presses the edge portion 5*a* of the sheet bundle 5 when the sheet bundle 5 together with the tape T is inserted into the portion between the first roller 71 and the second roller 72. In this manner, in the state where the edge portion 5*a* of the sheet bundle 5 is stretched so as to be substantially flat, the tape T is attached to the edge portion 5*a* of the sheet bundle 5.

For example, the sheet binding device 1 rotates the first roller 41 rearward, thereby drawing the sheet bundle 5 from the tape attachment unit 58. The sheet binding device 1 then moves the first pressing pad 83 and the second pressing pad 84 of the pair of tensile members 81A and 81B in the direction away from the sheet bundle 5. In this manner, the sheet bundle 5 is released from the sheet support unit 25.

Next, the control unit 26 (refer to FIG. 2) of the sheet binding device 1 will be described.

The control unit 26 is formed using a control circuit including a CPU, a ROM, and a RAM which are arranged in the sheet binding device 1. For example, the control unit 26 causes a processor such as a CPU to execute a program so as to control an operation of the sheet binding device 1. For example, the control unit 26 controls the above-described various operations relating to the bundle preparation unit 22, the sheet shifting unit 23, the tape processing unit 24, and the sheet support unit 25.

According to this configuration, it is possible to satisfactorily finish a bound portion of the sheet bundle 5 by preventing the tip end of the edge portion 5*a* of the sheet bundle 5 from buckling.

For example, if the multiple sheets S are shifted in the edge portion 5*a* of the sheet bundle 5, rigidity decreases in the tip end of the edge portion 5*a* of the sheet bundle 5. Therefore, if the tape T is attached to the edge portion 5*a* of the sheet bundle 5, there is a possibility that the tip end of the edge portion 5*a* of the sheet bundle 5 may buckle. If the tip end of the edge portion 5*a* of the sheet bundle 5 buckles, the tape T is disadvantageously attached to the edge portion 5*a* of the sheet bundle 5, in some cases. For example, in some cases, bonding strength is weakened between the sheets S and the tape T, or the bound portion of the sheet bundle 5 looks poor.

Therefore, in the embodiment described herein, the sheet binding device 1 includes the sheet support unit 25. The sheet support unit 25 holds a state where the multiple sheets S forming the sheet bundle 5 are shifted in the edge portion 5*a* of the sheet bundle 5, and presses the region A2 different from the tape attachment region A1 in the edge portion 5*a* of the sheet bundle 5 in the sheet bundle thickness direction Z so as to remove any slack. According to this configuration, the edge portion 5*a* of the sheet bundle 5 is pressed by the sheet support unit 25. Accordingly, the rigidity increases in the tip end portion of the edge portion 5*a* of the sheet bundle 5, and the tip end portion of the edge portion 5*a* of the sheet bundle 5 is less likely to buckle. In this manner, it is possible to satisfactorily finish the bound portion of the sheet bundle 5.

From another viewpoint, the sheet support unit 25 according to the embodiment described herein presses the sheet bundle 5 in the sheet bundle thickness direction Z, at a position on both sides of the tape attachment region A1 in the edge portion 5*a* of the sheet bundle 5, in a state where the multiple sheets S forming the sheet bundle 5 are shifted in the edge portion 5*a* of the sheet bundle 5. According to this configuration, the sheet bundle 5 is pressed at the position on both sides of the tape attachment region A1. Accordingly, the rigidity increases in the tape attachment region A1, and the tip end portion of the edge portion 5*a* of the sheet bundle 5 is less likely to buckle. Therefore, it is possible to satisfactorily finish the bound portion of the sheet bundle 5.

In the embodiment described herein, the sheet support unit 25 includes the tension applying unit (for example, the pair of tensile members 81A and 81B) which includes the tensile members 81A and 81B movable along the sheet width direction Y and which applies tension to the edge portion 5*a* of the sheet bundle 5 in the sheet width direction Y. According to this configuration, the tension applied in the sheet width direction Y brings the edge portion 5*a* of the sheet bundle 5 into a state of being stretched so as to be substantially flat. In this manner, the rigidity further increases in the tip end portion of the edge portion 5*a* of the sheet bundle 5.

In the embodiment described herein, the sheet support unit 25 includes the elastic member 87 on the surface 25*a* which comes into contact with at least the sheet bundle 5. According to this configuration, the sheet bundle 5 can be relatively firmly supported by the elastic member 87, and thus, it is possible to more reliably prevent the sheet bundle 5 from having any slack. In this manner, it is possible to more satisfactorily finish the bound portion of the sheet bundle 5.

If the sheet bundle 5 is relatively thick, the tip end portion of the sheet bundle 5 becomes less likely to buckle, in some cases. Accordingly, when the thickness of the sheet bundle 5 is equal to or smaller than a preset value, the sheet binding device 1 causes the sheet support unit 25 to press the edge portion 5*a* of the sheet bundle 5, based on information on the thickness of the bundle sheet 5. When the thickness of the sheet bundle 5 is greater than the reference value, the sheet support unit 25 may not perform the operation for pressing the edge portion 5*a* of the sheet bundle 5. The "information on the sheet bundle 5" described in this application is not limited to information which directly indicates the thickness of the sheet bundle 5 as described above. Information indicating the number of sheets S forming the sheet bundle 5 or other information (for example, information on the sheet S itself) may be included therein. The "information on the sheet bundle 5" may be received from the image forming apparatus 2 through the interface 21, or may be detected by a detection unit D (refer to FIG. 1) arranged in the sheet binding device 1. The detection unit D is an example of an "information acquisition unit". The "information acquisition unit" described in this application may obtain information of the sheet bundle 5 (for example, the information on the thickness of the sheet bundle 5) by acquiring the information on the sheet S itself as the information on the sheet bundle 5 and by performing counting or determination which is preset based on the acquired information on the sheet S itself. The description "based on the information on the sheet bundle 5 which is acquired by the information acquisition unit" in this application is not limited to a case based on the information which is directly acquired by the information acquisition unit. A case based on the information acquired by performing counting or the determination of the information which is directly acquired by the information acquisition unit is also included therein. If it is possible to omit the operation for pressing the edge portion 5*a* of the sheet bundle 5, processing speed of the sheet binding device 1 can be improved, and power consumption can be reduced.

The sheet binding device 1 may change a movement amount of the first pressing pad 83 and the second pressing pad 84, based on the information on the thickness of the sheet bundle 5. For example, the sheet binding device 1 may change pressing force for pressing the sheet bundle 5, based on the information on the thickness of the sheet bundle 5.

The sheet binding device 1 may change tension applied to the edge portion 5*a* of the sheet bundle 5, based on the information on the thickness of the sheet bundle 5. For example, when the thickness of the sheet bundle 5 is equal to or smaller than a preset reference value, the sheet binding device 1 may decrease the tension applied to the edge portion 5*a* of the sheet bundle 5. When the thickness of the sheet bundle 5 is greater than the reference value, the sheet binding device 1 may increase the tension applied to the edge portion 5*a* of the sheet bundle 5.

Based on information on a size of the sheet S or an orientation of the sheet S, the sheet binding device 1 may cause a movement mechanism (not illustrated) to change a position of the pair of tensile members 81A and 81B in the sheet width direction Y. In this manner, regardless of the size or the orientation of the sheet S, the pair of tensile members 81A and 81B more reliably hold both end portions 5*b*1 and 5*b*2 of the sheet S. The "information on the size of the sheet S or the orientation of the sheet S" maybe received from the image forming apparatus 2 through the interface 21, or may be detected by the detection unit D arranged in the sheet binding device 1.

(Second Embodiment)

Next, a second embodiment will be described. The embodiment described herein is different from the first embodiment in that the sheet support unit 25 includes multiple pairs of rollers 91A and 91B instead of the pair of tensile members 81A and 81B. The configurations other than the following are the same as those according to the first embodiment.

Figure 19:
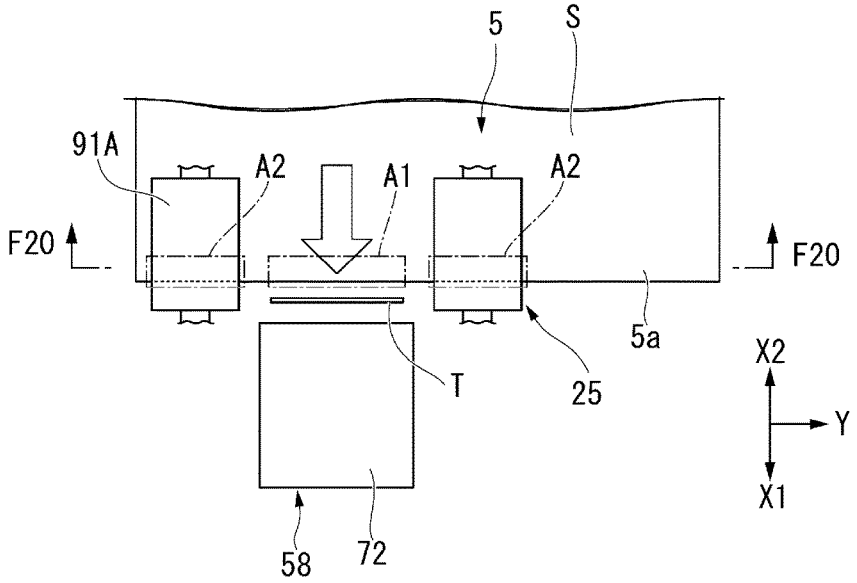
FIG. 19 is a plan view illustrating a sheet support unit according to a second embodiment.
Figure 20:
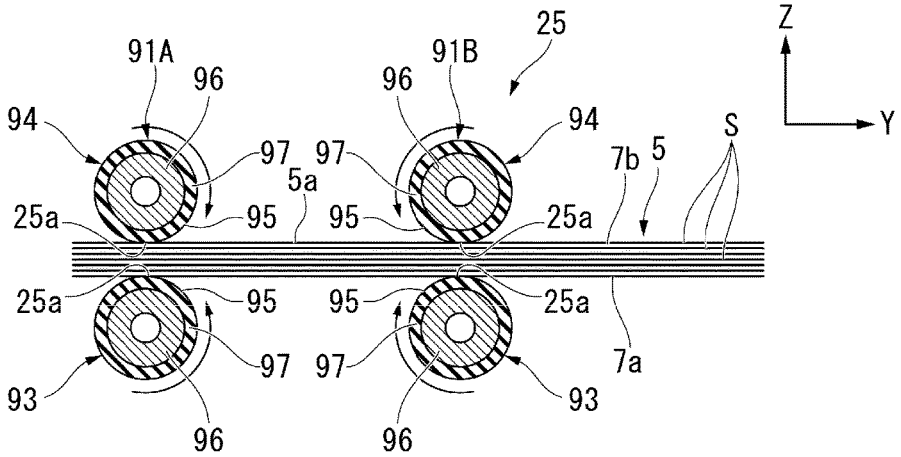
FIG. 20 is a sectional view taken along line F20-F20 of the sheet support unit illustrated in FIG. 19.

FIG. 19 is a plan view illustrating the sheet support unit 25 according to the embodiment described herein. FIG. 20 is a sectional view taken along line F20-F20 of the sheet support unit 25 illustrated in FIG. 19.

As illustrated in FIG. 19, the sheet support unit 25 according to the embodiment described herein includes the multiple pairs of rollers 91A and 91B which apply force going to the outer side of the sheet bundle 5 to the edge portion 5*a* of the sheet bundle 5 along the sheet width direction Y. The multiple pairs of rollers 91A and 91B face the edge portion 5*a* of the sheet bundle 5 in the sheet bundle thickness direction Z. The multiple pairs of rollers 91A and 91B are examples of the tension applying unit. The multiple pairs of rollers 91A and 91B apply tension to the edge portion 5*a* of the sheet bundle 5 in the sheet width direction Y.

From another viewpoint, the multiple pairs of rollers 91A and 91B are located separately on both sides of the tape attachment region A1 in the sheet width direction Y. The multiple pairs of rollers 91A and 91B press the edge portion 5*a* of the sheet bundle 5 in the sheet bundle thickness direction Z, at a position on both sides of the tape attachment region A1 in the sheet width direction Y.

As illustrated in FIG. 20, each of the multiple pairs of rollers 91A and 91B includes a first roller 93 and a second roller 94. The first roller 93 and the second roller 94 are located separately on both sides (for example, upper and lower sides) of the sheet bundle 5 in the sheet bundle thickness direction Z. The first roller 93 and the second roller 94 are movable in the direction towards each other and in the direction away from each other, by a movement mechanism (not illustrated). The first roller 93 and the second roller 94 are moved in the direction towards each other, thereby interposing and holding the edge portion 5*a* of the sheet bundle 5 between the first roller 93 and the second roller 94. Instead of the above-described configuration, any one of the first roller 93 and the second roller 94 may be fixed at a stationary position so that only the other one of the first roller 93 and the second roller 94 is movable.

The first roller 93 and the second roller 94 are driving rollers which are respectively driven by motors. The first roller 93 and the second roller 94 include a peripheral surface portion 95 which rotates in the sheet width direction Y. The peripheral surface portion 95 is an example of the "movable portion" which is movable along the sheet width direction Y.

Each of the first roller 93 and the second roller 94 includes an elastic member (for example, a rubber member) 97 on the surface 25*a* which comes into contact with at least the sheet bundle 5. For example, in the embodiment described herein, each of the first roller 93 and the second roller 94 includes a roller main body 96 which is rigid and the elastic member 97 attached to the roller main body 96. Alternatively, in each of the first roller 93 and the second roller 94, the entire body may be formed using the elastic member 97 (for example, a rubber member).

As illustrated in FIG. 19, the multiple pairs of rollers 91A and 91B are rotated by a driving mechanism (not illustrated), in a state where the bundle 5 is interposed between the first roller 93 and the second roller 94. In this manner, the multiple pairs of rollers 91A and 91B apply force going outward in the sheet width direction Y to the edge portion 5*a* of the sheet bundle 5. In this manner, tension acting along the sheet width direction Y is applied to the edge portion 5*a* of the sheet bundle 5. As a result, the edge portion 5*a* of the sheet bundle 5 is brought into a state of being stretched so as to be substantially flat.

According to this configuration, similarly to the first embodiment, it is possible to prevent the tip end portion of the edge portion 5*a* of the sheet bundle 5 from buckling. In this manner, it is possible to satisfactorily finish the bound portion of the sheet bundle 5.

In the embodiment described herein, the sheet support unit 25 includes the rollers 93 and 94 including the peripheral surface portion 95 which rotates in the sheet width direction Y. According to this configuration, the tension applied to the sheet bundle 5 from the rollers 93 and 94 brings the edge portion 5*a* of the sheet bundle 5 into a state of being stretched so as to be substantially flat. In this manner, the rigidity further increases in the tip end portion of the edge portion 5*a* of the sheet bundle 5.

(Third Embodiment)

Next, a third embodiment will be described. The embodiment described herein is different from the first embodiment in that the sheet support unit 25 includes a pressing member 101 instead of the pair of tensile members 81A and 81B. The configurations other than the following are the same as those according to the first embodiment.

Figure 21:
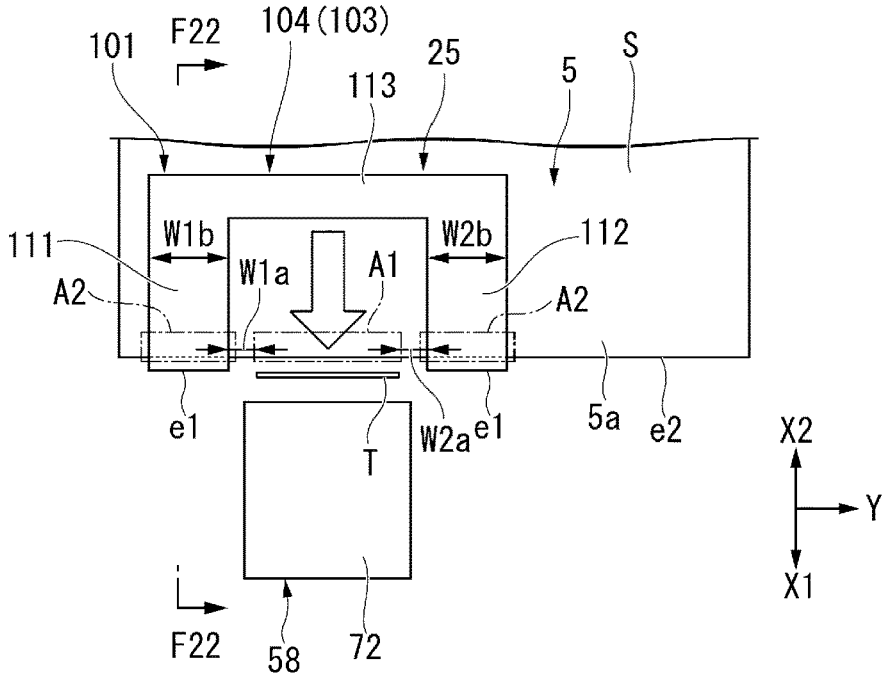
FIG. 21 is a plan view illustrating a sheet support unit according to a third embodiment.
Figure 22:
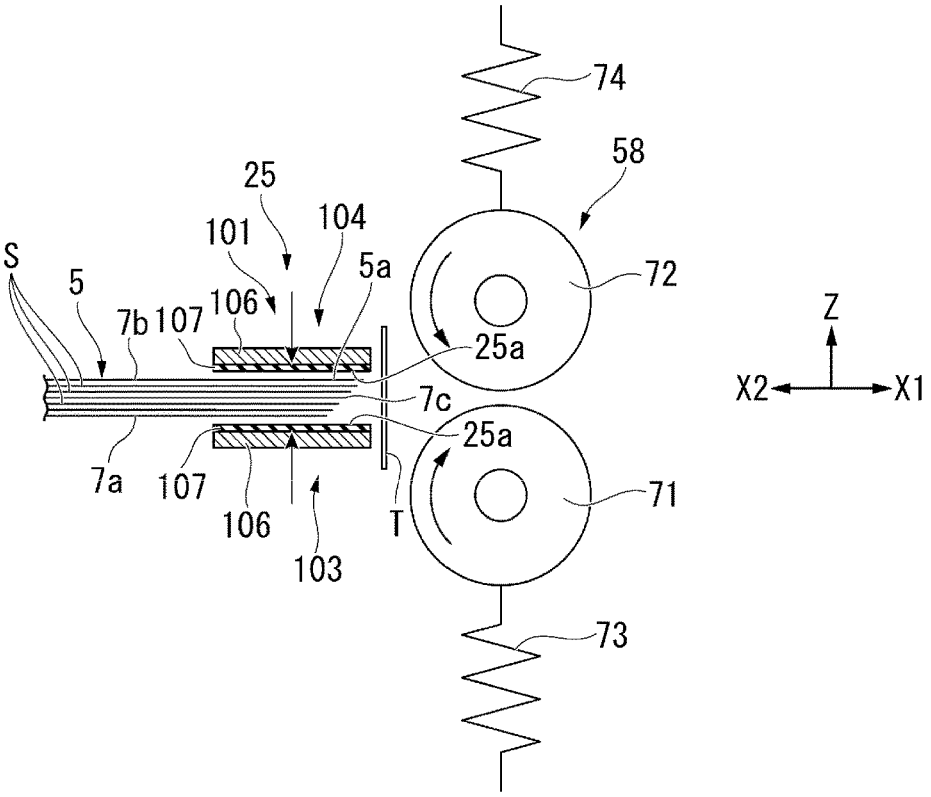
FIG. 22 is a sectional view taken along line F22-F22 of the sheet support unit illustrated in FIG. 21.

FIG. 21 is a plan view illustrating the sheet support unit 25 according to the embodiment described herein. FIG. 22 is a sectional view taken along line F22-F22 of the sheet support unit 25 illustrated in FIG. 21.

As illustrated in FIG. 21, the sheet support unit 25 according to the embodiment described herein includes the pressing member 101 which is arranged in the vicinity of the tape attachment region A1 so as to press the edge portion 5*a* of the sheet bundle 5 in the sheet bundle thickness direction Z, in the vicinity of the tape attachment region A1.

As illustrated in FIG. 22, the pressing member 101 includes a first pressing plate (first pressing portion) 103 and a second pressing plate (second pressing portion) 104. The first pressing plate 103 and the second pressing plate 104 are located separately on both sides (for example, upper and lower sides) of the sheet bundle 5 in the sheet bundle thickness direction Z. Each of the first pressing plate 103 and the second pressing plate 104 is movable in the direction towards each other and in the direction away from each other by a movement mechanism (not illustrated). The first pressing plate 103 and the second pressing plate 104 are moved in the direction towards each other, thereby interposing and holding the edge portion 5*a* of the sheet bundle 5 between the first pressing plate 103 and the second pressing plate 104. Instead of the above-described configuration, any one of the first pressing plate 103 and the second pressing plate 104 may be fixed at a stationary position so that only the other one of the first pressing plate 103 and the second pressing plate 104 is movable. The "pair of pressing plates" described in this application may mutually have different shapes or sizes.

As illustrated in FIG. 21, each of the first pressing plate 103 and the second pressing plate 104 includes a first portion 111, a second portion 112, and a third portion 113.

The first portion 111 and the second portion 112 are arranged corresponding to the edge portion 5*a* of the sheet bundle 5, and press the edge portion 5*a* of the sheet bundle 5 in the sheet bundle thickness direction Z. The first portion 111 and the second portion 112 are located separately on both sides of the tape attachment region A1 in the sheet width direction Y. In this manner, the first portion 111 and the second portion 112 press the sheet bundle 5 in the sheet bundle thickness direction Z, at a position on both sides of the tape attachment region A1 in the sheet width direction Y. In the embodiment described herein, each of the first portion 111 and the second portion 112 is located in the vicinity of the tape attachment region A1. For example, a width W1*a* in the sheet width direction Y between the first portion 111 and the tape attachment region A1 is narrower than a width W1*b* in the sheet width direction Y of the first portion 111. Similarly, a width W2*a* in the sheet width direction Y between the second portion 112 and the tape attachment region A1 is narrower than a width W2*b* in the sheet width direction Y of the second portion 112.

The third portion 113 extends between the first portion 111 and the second portion 112, and connects the first portion 111 and the second portion 112 to each other. In a state where the sheet support unit 25 presses the sheet bundle 5, the third portion 113 is located on the upstream side of the tape attachment unit 58 in the sheet conveying direction X1. In other words, the first portion 111, the second portion 112, and the third portion 113 surround the tape attachment unit 58 in three directions. The first portion 111, the second portion 112, and the third portion 113 are formed in a mutually integrated plate shape.

As illustrated in FIG. 22, each of the first pressing plate 103 and the second pressing plate 104 includes an elastic member (for example, a rubber member) 107 on the surface 25*a* which comes into contact with at least the sheet bundle 5. For example, in the embodiment described herein, each of the first pressing plate 103 and the second pressing plate 104 includes a pressing plate main body 106 which is rigid and the elastic member 107 attached to the pressing plate main body 106. Alternatively, in each of the first pressing plate 103 and the second pressing plate 104, the entire body may be formed using the elastic member 107 (for example, a rubber member).

According to this configuration, similarly to the first embodiment, it is possible to prevent the tip end portion of the edge portion 5*a* of the sheet bundle 5 from buckling. In this manner, it is possible to satisfactorily finish the bound portion of the sheet bundle 5.

In the embodiment described herein, the sheet support unit 25 includes the pair of pressing plates 103 and 104 which interpose the edge portion 5*a* of the sheet bundle 5 therebetween from both sides in the sheet bundle thickness direction Z. According to this configuration, the edge portion 5*a* of the sheet bundle 5 can be more reliably stretched so as to be substantially flat by the pressing member 101.

In the embodiment described herein, each of the pressing plates 103 and 104 includes the first portion 111 and the second portion 112 which are located separately on both sides of the tape attachment region A1 in the sheet width direction Y, and third portion 113 which connects the first portion 111 and the second portion 112 to each other. According to this configuration, the periphery of the tape attachment region A1 is more reliably stretched so as to be substantially flat by the first portion 111 and the second portion 112 which are connected by the third portion 113. In this manner, it is possible to satisfactorily finish the bound portion of the sheet bundle 5 by further preventing the tip end portion of the sheet bundle 5 from buckling. According to this configuration, it is possible to simplify the configuration of the sheet support unit 25. Therefore, it is possible to miniaturize the sheet binding device 1.

Hitherto, the first to third embodiments are described. However, the configurations according to the embodiments are not limited to the above-described examples. For example, similarly to the pair of tensile members 81A and 81B according to the first embodiment, operations relating to the multiple pairs of rollers 91A and 91B according to the second embodiment or the pressing member 101 according to the third embodiment may be controlled, based on the information on the thickness of the sheet bundle 5, the size of the sheet S, or the oration of the sheet S.

The direction in which the pair of tensile members 81A and 81B pull the sheet bundle 5 and the direction in which the pair of rollers 91A and 91B apply force to the sheet bundle 5 are not limited to the sheet width direction Y. Any other direction may be employed as long as the direction intersects the sheet conveying direction X1. The sheet support unit 25 may press both sides of the tape attachment region A1 in a direction different from the sheet width direction Y as long as the direction intersects the sheet conveying direction X1.

In the first embodiment, an example is described in which the first roller 41 is actively rotated and the second roller 42 is passively rotated in the sheet shifting unit 23. However, the configuration is not limited thereto. For example, both the first roller 41 and the second roller 42 may be independently rotated.

Figure 23:
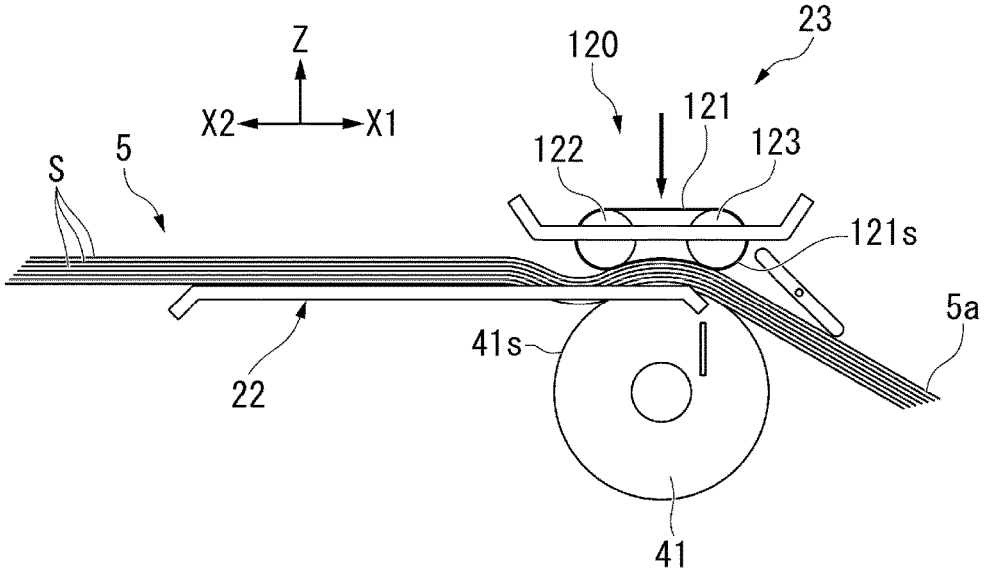
FIG. 23 is a front view illustrating a first modification example of a sheet shifting unit.

A configuration is not limited to a case where the sheet shifting unit 23 includes the first roller 41 and the second roller 42. For example, as illustrated in FIG. 23, the sheet shifting unit 23 may have a belt mechanism 120 instead of the second roller 42. The belt mechanism 120 is an example of a "second contact member". The belt mechanism 120 includes a belt 121, a first pulley 122, and a second pulley 123. If the belt mechanism 120 is moved toward the first roller 41, the sheet bundle 5 and an outer peripheral surface 121*s* of the belt 121 are deformed along the outer peripheral surface 41*s* of the first roller 41. In this state, the first roller 41 is rotated forward. In this manner, similarly to the first embodiment, the multiple sheets S are shifted in the edge portion 5*a* of the sheet bundle 5 in a stepwise manner.

Figure 24:
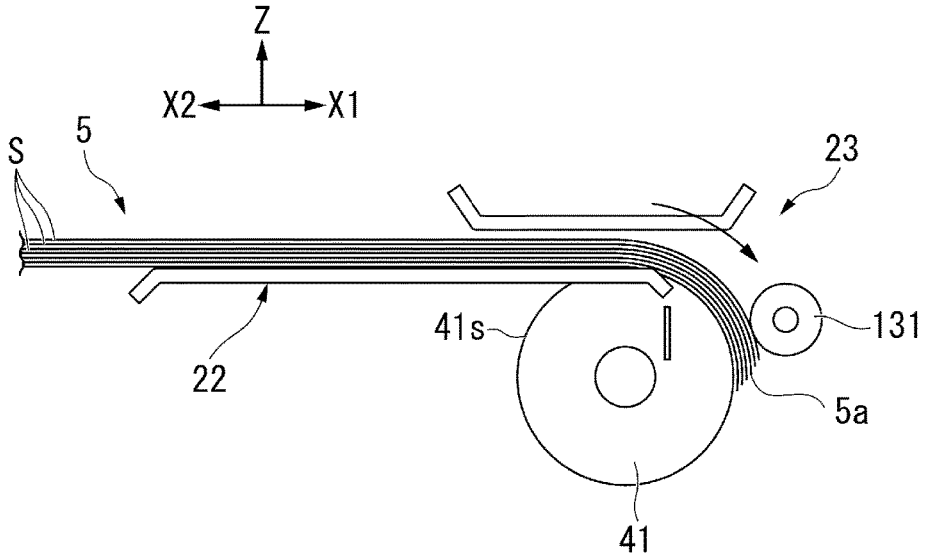
FIG. 24 is a front view illustrating a second modification example of the sheet shifting unit.

As illustrated in FIG. 24, the sheet shifting unit 23 may include the first roller 41 and a second roller 131 which is smaller than the first roller 41. The second roller 131 is an example of the "second contact member". In a state where the sheet bundle 5 is interposed between the first roller 41 and the second roller 131, the second roller 131 moves along the outer peripheral surface 41*s* of the first roller 41. In this manner, the multiple sheets S are shifted in the edge portion 5*a* of the sheet bundle 5 in the stepwise manner.

In the first embodiment, an example is described in which the first roller 71 and the second roller 72 in the tape attachment unit 58 are urged in the direction where both of these come into contact with each other, but a configuration is not limited thereto. For example, at least one of the first roller 71 and the second roller 72 may be urged where one comes into contact with the other.

According to at least any one embodiment described above, the sheet binding device includes the tape attachment unit and the sheet support unit. The sheet support unit holds a state where the multiple sheets forming the sheet bundle are shifted from each other in the edge portion of the sheet bundle, and presses the region different from the tape attachment region in the edge portion in the thickness direction of the sheet bundle so as to remove any slack. According to this configuration, it is possible to satisfactorily finish the bound portion of the sheet bundle by preventing the tip end portion of the edge portion of the sheet bundle from buckling.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet binding method comprising:

holding a sheet bundle in a state where multiple sheets forming the sheet bundle are shifted relative to each other at an edge portion of the sheet bundle;

applying, with a tension applying unit, tension to the edge portion of the sheet bundle in a sheet bundle width direction to remove any slack along the edge portion of the sheet bundle, wherein the tension applying unit includes a pair of tensile members configured to pull the edge portion of the sheet bundle in opposite directions;

pressing, in a sheet bundle thickness direction and in the state where the multiple sheets forming the sheet bundle are shifted relative to each other at the edge portion of the sheet bundle, a pressing region of the edge portion so that there is substantially no slack along the edge portion; and while the tension is applied with the tension applying unit and while the sheet bundle is pressed in the state where multiple sheets forming the sheet bundle are shifted relative to each other at the edge portion of the sheet bundle, applying tape to the edge portion of a sheet bundle at a tape attachment region of the edge portion different from the pressing region.

2. The method according to claim 1, wherein the sheet bundle is pressed with a pair of pressing portions that press the edge portion of the sheet bundle from both sides of the sheet bundle in the sheet bundle thickness direction.

3. The method according to claim 2, wherein the pressing portions each include an elastic member that comes into contact with the sheet bundle.

4. The method according to claim 1 further comprising:

shifting the sheets forming the bundle so that edges of the sheets are shifted relative to each other in the edge portion in a stepwise manner.

5. The method according to claim 4, wherein the sheets are shifted by a sheet shifting unit that includes a first roller and a second roller, the first roller having a deformable surface that deforms when pressed against a sheet bundle held between the first roller and the second roller.

6. The method according to claim 1, wherein the sheet bundle is pressed by a sheet support unit that includes a pressing member including a first portion and a second portion that each press a different pressing region on opposite sides of the tape attachment region in a sheet bundle width direction, and a third portion that connects the first portion and the second portion to each other.

7. A sheet binding method comprising:

holding a sheet bundle in a state where multiple sheets forming the sheet bundle are shifted relative to each other at an edge portion of the sheet bundle;

applying, with a tension applying unit, tension to the edge portion of the sheet bundle in a sheet bundle width direction to remove any slack along the edge portion of the sheet bundle, wherein the tension applying unit includes a pair of rollers configured to rotate to apply tension to the edge portion of the sheet bundle in opposite directions;

pressing, in a sheet bundle thickness direction and in the state where the multiple sheets forming the sheet bundle are shifted relative to each other at the edge portion of the sheet bundle, a pressing region of the edge portion so that there is substantially no slack along the edge portion; and while the tension is applied with the tension applying unit and while the sheet bundle is pressed in the state where multiple sheets forming the sheet bundle are shifted relative to each other at the edge portion of the sheet bundle, applying tape to the edge portion of a sheet bundle at a tape attachment region of the edge portion different from the pressing region.

8. A sheet binding method comprising:

holding a sheet bundle in a state where multiple sheets forming the sheet bundle are shifted relative to each other at an edge portion of the sheet bundle;

acquiring a thickness of the sheet bundle;

only when the thickness of the sheet bundle is greater than a predetermined thickness, pressing, in a sheet bundle thickness direction and in the state where the multiple sheets forming the sheet bundle are shifted relative to each other at the edge portion of the sheet bundle, a pressing region of the edge portion so that there is substantially no slack along the edge portion; and while the sheet bundle is pressed in the state where multiple sheets forming the sheet bundle are shifted relative to each other at the edge portion of the sheet bundle, applying tape to the edge portion of a sheet bundle at a tape attachment region of the edge portion different from the pressing region.

* * * * *